US010000032B2

(12) United States Patent
Spiesshofer et al.

(10) Patent No.: US 10,000,032 B2
(45) Date of Patent: Jun. 19, 2018

(54) METHOD FOR OPERATING A PRESS WITH AN UNDERNEATH DRIVE AND PRESS OPERATED ACCORDING THERETO

(75) Inventors: Thomas Spiesshofer, Bermatingen (DE); Gebhard Engler, Ertingen (DE); Markus Mueller, Gebesee (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 1283 days.

(21) Appl. No.: 14/110,438

(22) PCT Filed: Apr. 10, 2012

(86) PCT No.: PCT/DE2012/100097

§ 371 (c)(1),
(2), (4) Date: Oct. 8, 2013

(87) PCT Pub. No.: WO2012/139566

PCT Pub. Date: Oct. 18, 2012

(65) Prior Publication Data

US 2014/0137755 A1 May 22, 2014

(30) Foreign Application Priority Data

Apr. 12, 2011 (DE) ..... 10 2011 016 669

(51) Int. Cl.
*B30B 1/28* (2006.01)
*B30B 15/14* (2006.01)
(Continued)

(52) U.S. Cl.
CPC ..... *B30B 15/14* (2013.01); *B21D 24/12* (2013.01); *B30B 1/266* (2013.01); *B30B 1/28* (2013.01)

(58) Field of Classification Search
CPC ..... B30B 15/14; B30B 1/26; B30B 1/266; B30B 1/28; B21D 24/12
(Continued)

(56) References Cited

U.S. PATENT DOCUMENTS 6,041,699 A * 3/2000 Seto ..... B30B 1/103 100/282
2005/0274243 A1* 12/2005 Shiroza ..... B21D 24/10 83/13
(Continued)

FOREIGN PATENT DOCUMENTS

DE 102009017624 A1 * 10/2010 ..... B21D 24/10
DE 102010060103 A1 * 4/2012 ..... B21D 22/22
EP 2017071 A1 * 1/2009 ..... B21D 22/22

*Primary Examiner* — Jimmy T Nguyen
(74) *Attorney, Agent, or Firm* — Norman B. Thot

(57) ABSTRACT

A method and a press are proposed for an energy-efficient drive of a press (1) with a bottom drive, in which a drive device (2) disposed in a bottom section (3), a plunger (1.1) executing a stroke (H) and receiving an upper tool part (1.2) with at least one acting tie rod (2.1.2) of a drive train (2.1) are provided and the upper tool part (2.1) corresponding to a bottom tool part (3.2) disposed in the bottom section (3) machines or forms a work piece (5). The drive device (2) is operated by at least one motor (2.1.1) and by way of a control and regulation device (4) connecting the motor (2.1.1) and the drive train (2.1). Each drive train (2.1) can be operated by its own motor (2.1.1). When using a drawing device with a holder (3.3.1), it is operated in the change and during at least a partial path of the respective stroke (H) by the drive train (2.1) while observing a shaft-type free space (3.2) provided in the bottom section (3) in a coupled or decoupled manner by a releasable rotatory or translational active connection.

53 Claims, 10 Drawing Sheets

(51) Int. Cl.
*B21D 24/12* (2006.01)
*B30B 1/26* (2006.01)

(58) Field of Classification Search
USPC ..... 100/282, 283, 269.13, 35, 259; 72/450
See application file for complete search history.

(56) References Cited

U.S. PATENT DOCUMENTS

2007/0062247 A1* 3/2007 Hofele ..... B30B 1/18
72/441
2007/0240479 A1* 10/2007 Nagai ..... B21D 22/22
72/348
2009/0090161 A1* 4/2009 Amino ..... B21D 22/22
72/453.12

* cited by examiner

Fig. 2.1
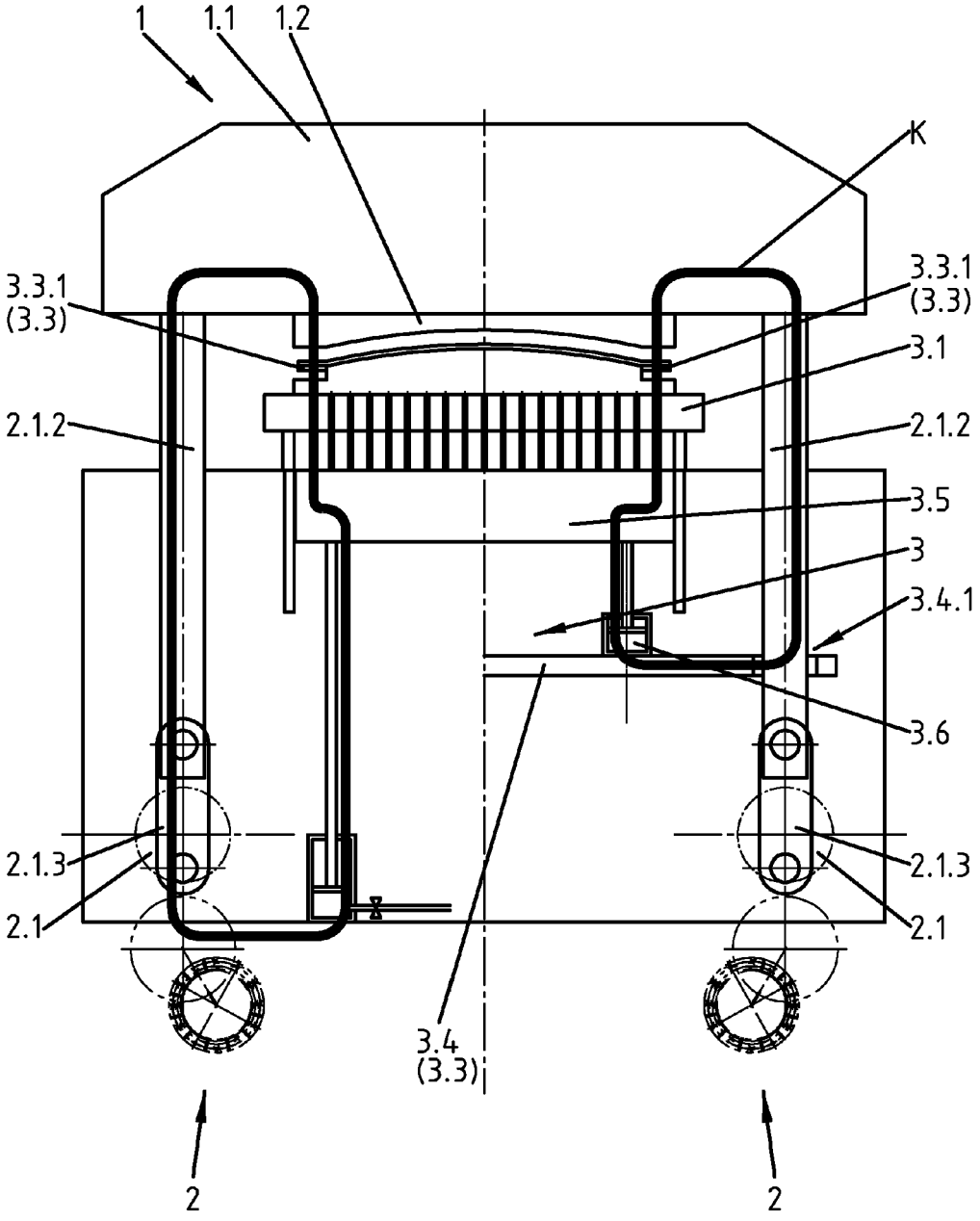

Fig. 6.1
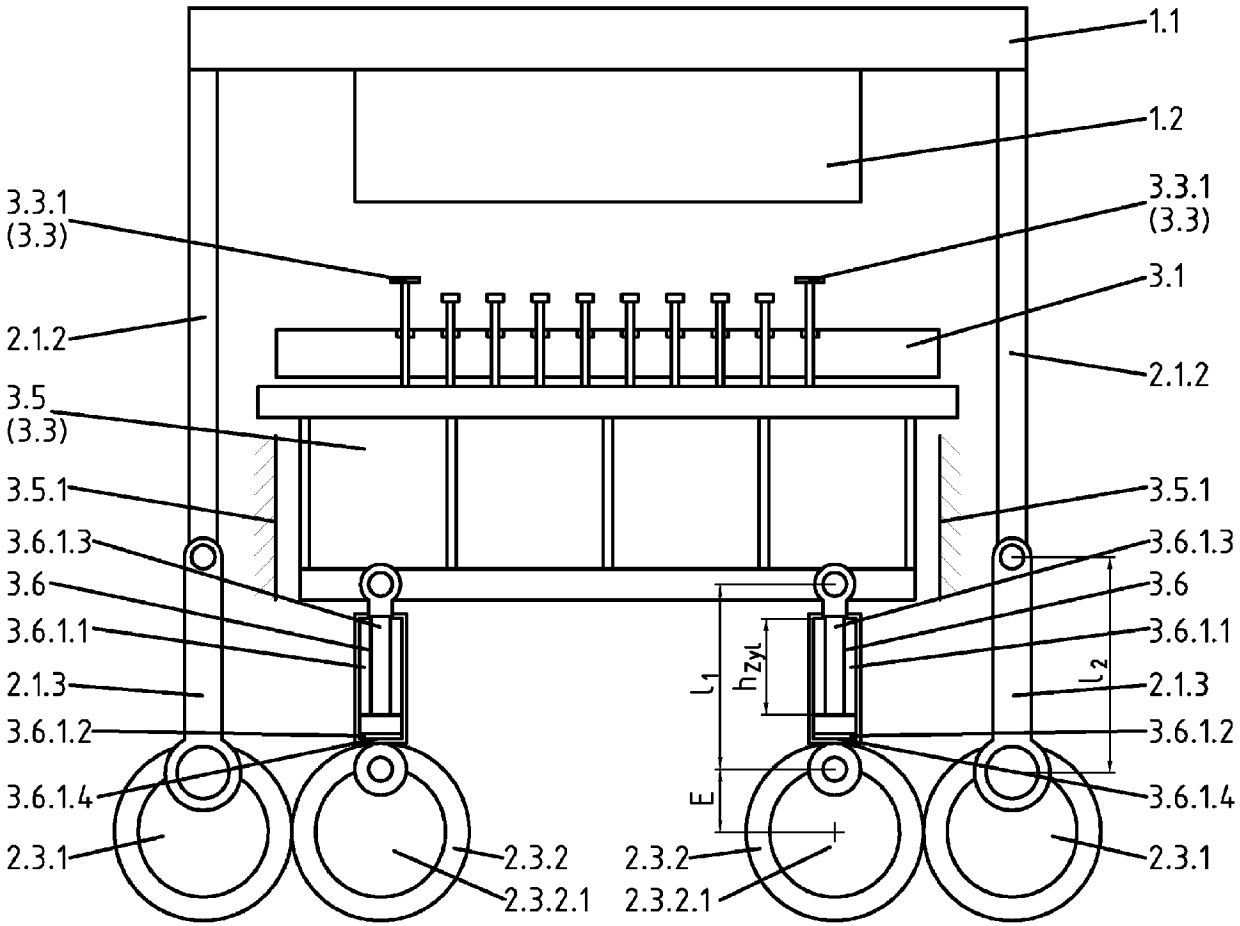

Fig. 6.2
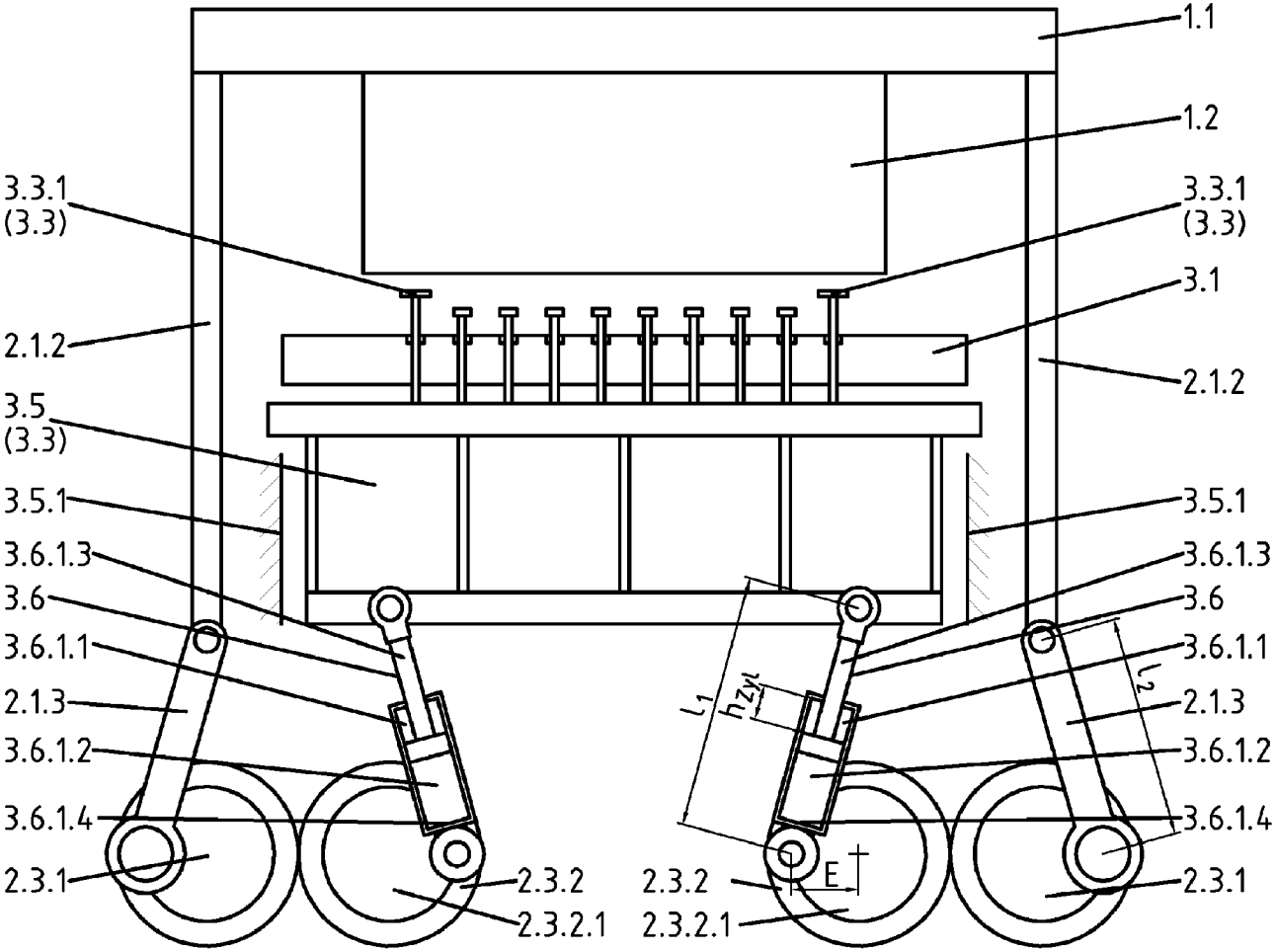

Fig. 7.1
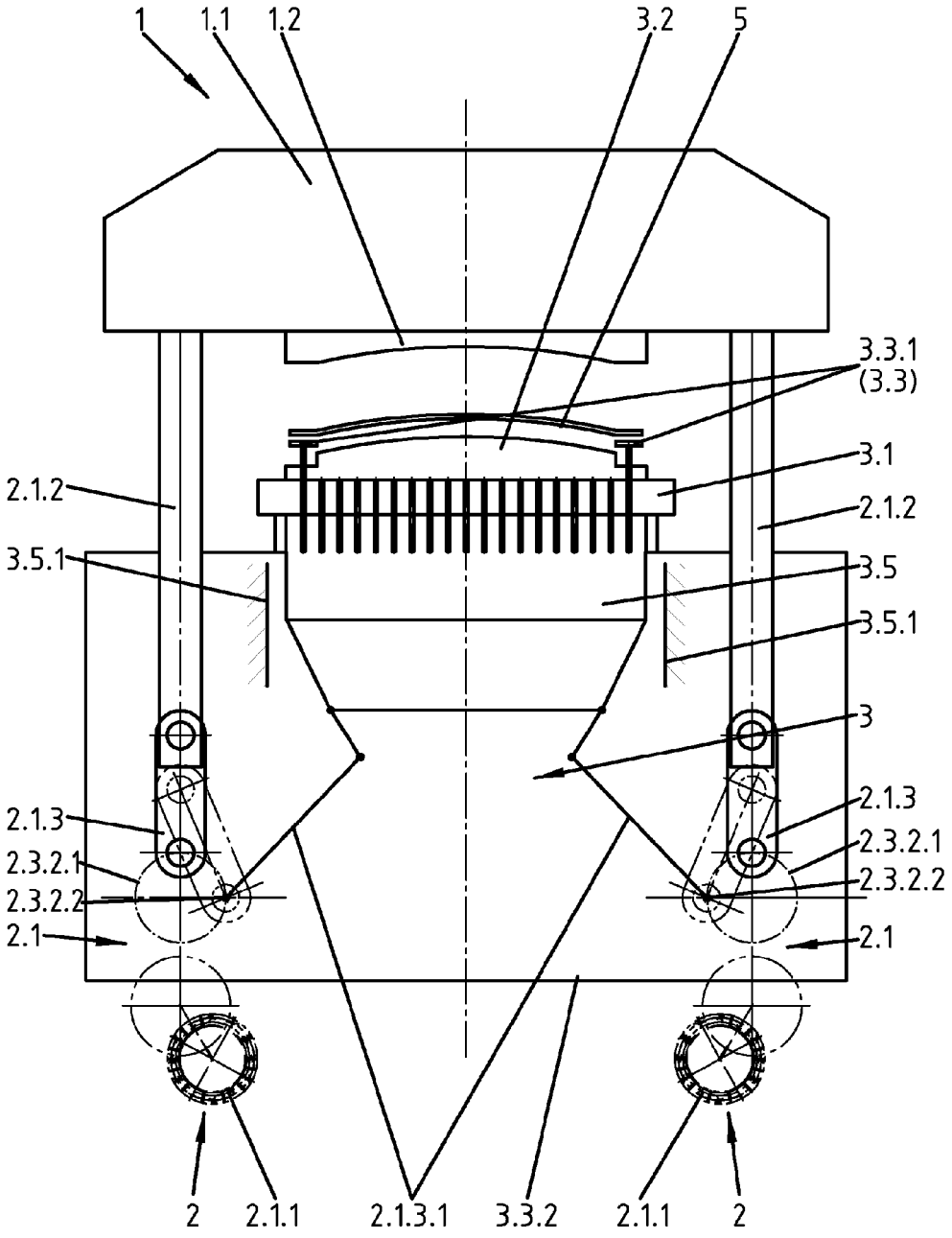

METHOD FOR OPERATING A PRESS WITH AN UNDERNEATH DRIVE AND PRESS OPERATED ACCORDING THERETO

TECHNICAL FIELD

The invention relates to a method for operating a press with a bottom drive as well as a press operated accordingly, which comprises at least one drive arrangement generating a force disposed in a bottom section and connected to at least one drive train, at least one plunger receiving at least one upper tool part, executing a stroke and transmitting the force, at least one tie rod engaging with the plunger for transmitting the drive for the stroke of the plunger and at least one bottom tool part associated to the plunger and the corresponding upper tool part and disposed on the bottom section, preferably a table, wherein a work piece or material is machined or formed between the bottom tool part and the upper tool part.

For the purposes of the invention, the press is to be used for forming or forging work pieces, compacting or stamping and also for cutting materials of any type as well as a transfer press and for being integrated into press lines.

THE PRIOR ART

A generic type of presses as defined in the introduction is known from the prior art.

In general, the prior art teaches that the plunger is frequently driven by a compact drive device in a bottom section of the press by way of a combination of tie rods—also in combination with a connecting rod.

It is known from the doctrinal technical literature that presses with bottom drives are predominantly implemented as presses with a small nominal force and a high number of strokes and less frequently for so-called large presses.

In such forming presses, this is justified by the fact that due to the spatial arrangement of the bottom drive, there remains little space in the table for drawing devices such as drawing cushions and, if necessary, for removal of cutting waste or the arrangement of ejectors as well as for the accessibility required for maintenance and repair.

In large presses however, the known installation of devices such as drawing cushions and, if necessary, ejectors in the plunger had to be discarded because it is technologically disadvantageous more specifically for installing large presses in transfer lines or in embodiments with individual plungers.

In large presses, the tie rods/connecting rods are also frequently disposed and guided in posts—at least above the bottom section—which are connected to a cross beam located above the posts and forming the plunger and are designed as a quasi-press frame for the occurring forces (action and reaction forces).

Due to the advantages of presses with a top drive demonstrated and recognized by experts, presses with bottom drives, more specifically as large presses have been somewhat forgotten. Nevertheless, economically advantageous solutions for developing presses with bottom drives—also as large presses—must be found, without putting up however with the disadvantages identified in the following examples.

The analysis of the exemplary embodiments of presses with bottom drives known as individual solutions shows the following disadvantages, which have to date substantially hindered the implementation of presses with bottom drives as large presses:

AT 215 257 B: The protruding flywheel requires a large building space. The complex lever kinematics renders a potentially necessary impact dampening ineffective, which, if required, could only be compensated for at high cost in terms of material. The inevitable transfer of eccentric forces mentioned above is inefficient due to the soft-responsive lever kinematics. The relatively numerous moving machine elements create only small relative movements for an efficient plunger stroke when high pressure forces are to be transferred.

DE 25 07 098 A1: This press requires a large building space due large components. The lever kinematics is disadvantageously disposed partially in the bottom section and partially in the upper post structure, so that the top part of the post structure becomes an essential, forces absorbing part of the press. Integrating this press into the configuration of modern transfer presses is not possible without additional travel paths such as so-called block bypasses in the T-track.

DE 29 12 927 A1: Due to the drive and lever kinematics, the arrangement and mode of operation do not leave any space for discharging waste accumulating as a consequence of the process, such as cuts. However, in modern press construction the logistics of waste removal, more specifically of transfer presses or press lines, play an important role in order to avoid technologically unwanted times.

DD 119 014 A5: The constructional height and complex guides do not allow integration into lines of said transfer presses or press lines.

Further developments of presses with a bottom drive comprise more or less specific improvements, which, for example

- according to EP 1 038 658 A2, further develop a lever kinematics of the drive or
- according to JP 2001150198 A describe a connecting rod/lever combination or
- according to DE 10 2009 055 739 design the drive device with regard to the coupling of the plunger with the connecting rods, without conveying to the person skilled in the art a teaching regarding improved functions in the force gradient and path of the plunger and its stroke in relation to a drawing cushion device.

However, in order to improve presses with a bottom drive to the effect that they ensure an optimized force and path progression of the plunger and its stroke and act in a differentiated manner according to the machining requirements and can also cover a larger operating area, it has already been proposed in accordance with the patent application number DE 10 2010 035 349.3 to record values of operating states in the system of the press by means of a control and regulation device and to process it into data according to a function and use it for the movement of the plunger. Thus the press can be operated in a controlled or regulated manner according to a system of forces required for the work piece.

In addition, it is to be noted that when constructing presses with a bottom drive; disposing additional customary devices such as drawing devices with the drawing cushions mentioned above, which support the forming process, in the bottom structure, is hindered due to lack of space.

In customary presses with a top drive, which frequently have a closed base frame, in which the plunger is guided and in which a relatively complex support is mounted, the drive for a drawing cushion and the latter are accommodated without any problems.

This reveals the problem of solving both the mentioned logistics for removal of cutting waste accumulating in the forming process and, above all, the inclusion of the required function of a drawing device with a drawing cushion in presses with a bottom drive.

The customary solutions of presses with drawing devices and drawing cushions for supporting the drawing stage can so far pursued be at least regardless of the classification of the presses as presses with a top drive or presses with a bottom drive.

In the light of an ascertained neglect of the further development of presses with bottom drives as large presses, and bearing in mind the advantages of top drives prevailing among experts, it can be assumed that the known solutions of drawing devices with drawing cushions were concerned with presses with top drives.

Thus, a study of drawing devices with drawing cushions disclosed in patent specifications shows the following result:

DE 4028921 A1: This trend-setting drawing device has become known as a so-called "energy-saving cushion", reduced energy losses and resulted in decoupling a pneumatic cylinder provided for lifting the drawing cushion with a blank holder from multiple piston/cylinder units by a combination of a piston/cylinder unit connected to the press table of the drawing device for lifting the blank holder into a top position while simultaneously supporting the drawing cushion. Due to the required mechanical effort, applying this kinematics to the spatial arrangement of a desired large press with a bottom drive is not possible without further research, because the cylinders and the drawing cushion must have the same path as the plunger stroke. This requires a large installation space and corresponding hydraulic power.

Despite implementing an advantageous closed force flow between the press plunger and drawing cushion, whereby the total press force corresponds only to the forming force, the functional and energetic advantage of this solution is reduced by extensive technical and structural charges.

EP 1 082 185 B1: In this deep drawing press, the drawing cushion has its own motor drive, connected by way of shafts, which however does not allow for an energy-saving integration into presses with a bottom drive. When using this drawing cushion in the underfloor machine, the shaft lengths would in this case have to correspond to the plunger stroke, which would lead to an expensive and structurally complex solution. In addition, due to the electric drive, the energetic power expenditure would be disproportionately high.

DE 10 2004 030 678 A1/DE 10 2005 012 876 A1/DE 10 2005 026 818 B4: These advanced solutions for drawing cushions are meant to electrically implement a desired energetic effect for reducing the control and regulation effort, but are not applicable for large presses with the advantages of a bottom drive to be implemented. In this solution, the forces and movements are implemented by different components. Here too the entire plunger stroke would have to be reproduced.

DE 2005 012 876 A1: A method and a device for control and regulation of servo-electric drawing cushions on presses, in which a stable and precise process is made possible on the one hand in the phase of the force-regulated drawing process and on the other hand in all phases of the position-controlled movement of the cushion, by means of a control and regulation as well as a small number of steps in the control and regulation sequence.

With this method and device, drawing cushions driven by means of servo-electric drives are used on the one hand as the drawing cushions in the table acting on the bottom tool and on the other hand, as the drawing cushions in the plunger acting on the upper tool. The drawing cushions can be implemented as one point or multipoint drawing cushions.

In order to control and regulate the drawing cushion, the principle of a drive shaft driven electronic cam disc regulation is combined with force regulation in such a manner that all movement phases of the drawing cushion, which occur without a mechanical contact with the press plunger, are controlled by way of electronic position cam discs, while the movements with contact with the press plunger occur by way of a force regulation by means of a path-dependently controlled profile of a force target value.

This way, an advantage with respect to a synchronicity of the movement of the drawing cushion with that of the plunger is achieved, which can also be maintained in case of speed variations and emergency stops of the plunger movement, without any special control functions being needed to this end.

However, switching between position control and force control with the control means according to the invention, on the one hand by way of limit switches, and on the other hand by determining the path of the position cam disc relative to the position of the plunger, requires specific mechanisms, such as cam discs above the plunger position, for example, in order to enforce the cushion position by way of the movement of the press plunger for example.

Hereby, due to a dynamic force limitation, a sensitive point is achieving a switch-over to force control, although improved conditions for a precise and reproducible sequence of the drawing process are to be created.

A significant disadvantage of this technical solution is that it concerns an open system. This means that the force of the drawing cushion counteracts the force of the plunger and thus that the total drive force of the plunger equals the sum of the forces that are required for forming the part in addition to the force of the drawing cushion acting contrary to the plunger force.

The parallelly as well as sequentially occurring process steps disclosed in this solution have an advantageous impact on the operation of the machine, however, they have no influence on the fundamental structure of the machine and thus on the force flow.

Therefore, with regard specifically to the force flow and thus to the entire structure of the machine, the object underlying the invention aims at providing a solution that is to be designed in such a manner that the force of the cushion occurs within a closed force flow between the cushion and the plunger and that the total force of the press does not have to be increased by the force of the cushion, and that the total force of the press corresponds merely to the forming force.

DE 10 2005 026 818 A1: According to this, a drawing cushion device is to be improved in such a manner that the control behavior is improved while reducing the control and regulation effort and that a variable force distribution on the blank holder can be made possible with a design that is as compact as possible.

The essence of this invention consists in regulating the pressure application on the blank holder with at least one linear and/or rotatory direct drive and, in a drawing cushion device with NC-drives, using an electric drive for each pressure point of a blank holder that is respectively independent from neighboring pressure points, wherein the electric drives are electrically asynchronously or synchronously controllable in a position- and/or force-controlled manner relative to each other and are connected to the drives for the main movement of the plunger and/or the ancillary movements of work piece transport elements by way of one, at least sequentially usable drive shaft on the one hand, and by way of energy storage and/or energy exchange modules, on the other hand. Thereby, several configurations of multipoint drawing cushion devices are possible, wherein all electric drives can be force and position-controlled together, or only a part of the force-controlled electric drives can be additionally position-controlled, or at least one additional electric drive can be position-controlled.

Linear or rotatory direct drives on the one hand and servomotors with downstream linear converters on the other hand can be used as force and/or position-controlled electric drives. Linear motors are provided as linear direct drives in the inner and outer areas of the pressure cheeks.

An advantageous solution already provides that the secondary part belonging to the linear motor is attached to the pressure cheek, across from which one or more primary parts stored in the press table are disposed depending on the required force.

In addition, when using multipart pressure cheeks, the exterior linear motor allows for a common use of primary and secondary parts by neighboring drawing cushion devices.

Through this direct energy transformation into a linear force and path function, transmissions that cause complex mechanical, increased moments of inertia can be dispensed with, whereby higher outputs become possible on the output side as a consequence of reduced moments of inertia. Thus, the blank holder can be controlled by means of a combination of at least one linear direct drive and at least one linear converter operatively connected with an electric drive.

A convenient force and position regulation thus occurs by way of the electric drives on the blank holder, which in conjunction with the movement of the plunger, allows for drawing the formed parts per press stroke.

With the possibility of controlling the individual electric drive for applying a force independently from the neighboring electric drives in the drawing phase, varying pressures can be adjusted in the corresponding blank holder areas, wherein i.a. the energy gained during the drawing phase in the brake mode of the electric drive can be fed back.

While bearing in mind the objective of a rational energy use in the press operation, such presses that are to be implemented as large presses—also in transfer operation—can be further improved with regard to energy performance data and compact design in the mentioned technological steps of drawing by means of energy-efficient drive kinematics as well as in e.g., technological steps of discharging machining waste, if the path followed by the control of the drawing device according to this, which has so far been reproducing or following the complete plunger stroke, is still taken into consideration.

This solution is also based on the system of an open force flow, wherein, in this case, the total press force is composed of the forming force plus the drawing cushion force counteracting it. Although a partial recovery of the used energy is energetically possible, such a machine would however still have to be dimensioned accordingly stronger with regard to forces.

The other technical solutions and physical active principles proposed therein are merely subordinate to the problem, in order to propose analogue deviations of the used components, which relate to the structure of the machine.

Approaches to solutions for modified force flows, which could be inventively stimulating, are not being addressed.

DE 10 2006 058 630 A1: The proposed e-hydraulic drawing cushion drive proposed here serves for recovering energy during the drawing process, but requires its own drive, the accommodation of which in presses with bottom drives is disadvantageous. In this solution also, the plunger stroke must be reproduced in the drawing cushion. Another disadvantage of this solution is that a high hydraulic effort must be operated and the corresponding electrical power must be integrated in the form of an electric motor/generator and converter, which results in a more expensive solution.

DE 10 2007 058 152 A1: Here, in order to ensure a simple overload protection in the drawing cushion device with a hybrid drive, a second, electric drive is used in addition to the first drive, wherein said intended solution for preventing malfunctions would be implementable only in a complex manner in presses with bottom drives. As has already been criticized, in this solution the drawing device must reproduce the complete plunger stroke.

Overall, the examined solutions of drawing devices with drawing cushions reveal their expedient use in presses with top drives, but due to the spatially complex kinematics, they are however not transposable, along with their energetic advantages, to presses with bottom drives without further consideration.

Therefore, the drawing process as such must be summed up once more, in order to be able to successfully use drawing devices with drawing cushions also in presses with bottom drives.

Since the work piece disposed on a holder is machined as a drawn part between a bottom tool and the correspondingly acting upper tool, a counterforce must act by way of said drawing cushion against the force of the descending plunger. The required output is a product of counterforce times distance. The force of the plunger acting from above onto the holder is able to store a part of the energy in a working appliance generating the counterforce—such as a piston-cylinder unit. After the drawing process, this stored energy acts as a restoring force during lifting of the plunger and can relieve the drive of the plunger.

Depending on how the drawing cushion is lifted from its bottom position, including through any types of separate or coupled drives, more or less energy is lost or can be used.

Experts have already addressed the matter of coupling the movement of the plunger with a crossbeam connected to the holder by way of tie rods in presses with top drives (see DE 4028921 A1), in order to regain the energy stored during the descent of the plunger. This solution in turn requires an at least spatially high mechanical effort, if not complicated control systems, if one wants to apply this solution to presses with bottom drives.

As quintessence of the analyzed state of the art it must be noted, that the experts have focused either exclusively on the development of underfloor mechanical engineering or of drawing cushion engineering, with corresponding regulation and control systems.

Apparently, the search for a closed force flow in the complex sense was not pursued, probably because of the (seemingly) predominant disadvantages, which oppose an allocation of said drawing devices in presses with a bottom drive.

EXPLANATION OF THE NATURE OF THE INVENTION

The Object

The object of the invention is to create a method for operating a press with a bottom drive and a press of the type mentioned in the introduction, in which the bottom section and the bottom drive are to be designed in such a manner that a functional, technologically usable area—also e.g., in technological stages of drawing with a drawing device and energy-efficient drive kinematics as well as e.g., in technological stages of discharging machining waste—is formed, so that the press to be designed as a large press can have a compact design and be economically operated as a transfer press as well as in transfer lines with energetically optimized performance characteristics.

Thereby, the method and the press should be designed in such a way that when using a drawing device, the plunger stroke and the drawing device are operated together or separately and an energetically advantageous and closed force progression is implemented.

The new technical solution to be developed accordingly, aims at combining the functional and energetic advantages of a closed force flow with modern regulation and control devices, and to implement them with comparatively low constructional effort.

The new solution thus aims at exposing the potential of the construction features of a press with an underfloor drive, in order to implement the pursued complex closed force flow.

The Solution

The object is solved via the method and via the press of the present invention.

The method is generally based on a press with a bottom drive, in which a work piece is machined or formed by means of

- a drive device disposed in a bottom section,
- at least one plunger executing a stroke and receiving an upper tool part, with at least one acting tie rod of a drive train and
- at least one upper tool part corresponding to at least one bottom tool part disposed in the bottom section and the drive device is driven by at least one motor and when using a drawing device, its path is operated so that it is coupled or decoupled with the full stroke of the plunger, wherein the stroke of the plunger and the drawing device are always operated in a closed force flow.

At least one drive train is operated by way of at least one motor connected to a control and regulation device. Preferably, with e.g., two or more drive trains, each drive train is operated by its own motor while observing a shaft-type free space provided in the bottom section. This free space can be used at least as a removal shaft for machining waste. In addition, the drive trains must also be able to operate a drawing device in such a manner that its path does not reproduce or follow the complete plunger stroke and the stroke of the plunger and the drawing device can not only be operated together but also separately.

Said free space thus discloses a special variant of a method in accordance with the object, if the use of a drawing device with a holder for the work piece is mandatory.

The analysis of the prior art shows that this free space in the bottom section—whether as a functional requirement for a removal shaft or for a drawing device—has been practically non-existent to date, since the previous embodiments of the drive and of the drive trains—mentioned above as disadvantages—did not allow it.

Thus, only if the method according to the invention is based on the use of a drawing device with a holder for the work piece, does it become possible to operate the movement sequence of the drawing device in this free space in the bottom section. Thus, each drive train of the drawing device can also be operated in the change of the respective stroke in a coupled or decoupled manner by means of a releasable rotatory or translational active connection.

A characteristic of the method is that the drawing device is operated in such a manner that it does not reproduce or follow the full stroke of the plunger.

Hereby, it can be determined according to the analysis of the prior art that previous active connections between whatever drive train and whatever drawing device always necessarily followed the path of the plunger.

In accordance with the object of the invention, releasable rotatory or translational active connections are created, which are operated in a coupled and/or decoupled manner during the change of the respective stroke. Rotatory active connections must be understood as such active connections that are coupled and/or decoupled by way of rotatory elements acting by positive, frictional (if necessary with slip) and/or force-fit engagement. The alternative translational active connections are connections that are coupled and/or decoupled by way of elements that act by positive, frictional and/or force-fit engagement and transmit linear movements. The elements acting by frictional engagement are also to be understood as such elements that implement a force by gradually sliding/slipping to a full transition from one element to the other. In rotatory active connections, friction couplings and in translational active connections, brake shoe type elements can cause this until the respective force-fit is implemented.

The resulting solutions developed according to the invention also allow for hybrid active connections, i.e., rotatory and translational active connections, in order to implement the object.

As a matter of principle, as particularly highlighted by the invention, it becomes possible to operate the drive train of the drawing device in a coupled manner during at least a partial path of the downward stroke, and to operate the drive train of the drawing device in a decoupled manner during at least a path travel of the upward stroke and thereby to operate the drawing device so that it does not reproduce or follow the path of the complete plunger stroke.

This teaching according to the invention alone shows the surprising advantage compared to the previously trend-setting, but now outdated prior art according to DE 4028921 A1, wherein the drawing device must necessarily follow the path of the plunger stroke, which requires at least a large available space and corresponding hydraulic outputs and is moreover energetically disadvantageous.

The method varies the position of one element of the drawing device configured as a carrier unit with an intermediate level or a pressure cheek or an intermediate level and a pressure cheek or with only a pressure cheek by means of a at least one first force-generating means in such a manner that the active connection is alternately closed and released by positive, frictional and/or force-fit engagement.

Alternatively, the method must also permit that the position of said carrier unit cannot be varied relative to the holder.

The method is further completable, if the active connection is closed or released depending on at least one of the values or gradients of forming forces and paths to be transmitted, of one of the positions of the work stages of forming, of the drive elements, of the positions of the plunger, of the holder, of the carrier unit or of a speed.

The method is performed in steps so that

- the plunger operated downward from or before or after a top dead center is moved toward a holder located in an upper initial position and the holder in an active connection with the carrier unit of the drawing device is moved downward directly before the impact of a hit of the plunger connected to the upper tool part acting onto the holder, so that when the upper tool part impacts on the holder, the holder is already moved in a pre-accelerated manner up to a first position and the impact loading is reduced, after the impact of the upper tool part onto the holder, the active connection between at least one of the elements of the drive train and the carrier unit of the drawing device is closed and they are moved together to a bottom end position of the holder, and the plunger with the upper tool part are moved together to its bottom dead center and to a second position, wherein alternately, the active connection between at least one of the elements of the drive trains and the carrier unit of the drawing device are released together once the plunger has reached its bottom dead center.

Hereby, it is made possible in accordance with practice, to operate the plunger both so that it cyclically runs through the top dead center and so that it executes a single stroke from before or after the top dead center, namely without having to reach the top dead center. In practice, the plunger operated in a single stroke before or after the top dead center, i.e., that does not cyclically run through the upper dead center, is also called reciprocating operation.

The subsequent sequence of the method can then be implemented in one or more of the steps, such as the upwards operated plunger is operated so that it is coupled with the upper tool part and the carrier unit of the drawing device after the bottom end position, the active connection of the holder either with the intermediate level or the pressure cheek or the intermediate level and the pressure cheek of the carrier unit of the drawing device is released after the lower end position of the bracket, the plunger is operated with the upper tool part and the intermediate level or the pressure cheek or the intermediate level and the pressure cheek separately from the holder to its upper initial position, the plunger is operated with the upper tool part from a third position immediately before reaching the upper initial position of the holder so that it is decoupled from the intermediate level or the pressure cheek or the intermediate level and the pressure cheek.

Based on at least one of the above sequences, the method is implemented as a variant of a rotatory active connection in such a manner that a) first, when the plunger is in an initial position corresponding to the top dead center and the pressure cheek and holder are in an upper initial position, a piston rod is partially extended in a cylinder of the first force-generating means and the cylinder is in an intermediate position, b) when the plunger initiates a downward movement, an engagement occurs with a first wheel of a gear of a rotatory coupling comprising a second wheel, by means of a tie rod eccentrically coupled to the first wheel, wherein said second wheel comprises an eccentric coupling element acting by a positive, frictional and/or force-fit engagement and allowing for a movement relative to the second wheel, and the holder thereby remains in its top initial position, wherein a bottom chamber in the cylinder is loaded with a controlled or regulated medium, so that the cylinder extends according to the movement of the pair of wheels and the holder thus remains in the top initial position, c) when the holder begins to pre-accelerate toward the first position, the volume flow of the medium to the bottom chamber of the cylinder is reduced shortly before the plunger impacts on the holder, and a downward movement of the holder is thus initiated, independently of whether medium is correspondingly supplied into an upper chamber or not, d) the plunger in the first position then impacts on the holder and a pressure is generated in the bottom chamber of the cylinder and an action (force) of the cylinder is transmitted by way of the pressure cheek to the holder, which rests on the upper tool part moving downward, and e) the work piece to be formed is clamped and formed in an energy-saving manner by means of a closed power flow, starting at the cylinder, and continuing via the pressure cheek, the holder, the upper tool part, the plunger, the tie rods, the connecting rods, the first wheel and the second wheel, wherein the forming process occurs up to the bottom dead center in the cylinder while actively controlling/regulating the pressure, independently of whether a volume of the medium is supplied or not.

In operational terms, the method is influenced in such a manner that the stroke of the plunger, a stroke of the holder and a stroke in the cylinder are controlled according to the relationship $h_{Zyl} \geq H-h$, in accordance with an eccentricity existing in the above-mentioned second wheel in connection with the eccentric coupling element, so that in the combination of the cylinder with the eccentric coupling element of the second wheel, the stroke of the cylinder which now merely serves for force generation is relatively small and a length of a connection of the first force-generating means between the pressure cheek and the eccentric coupling element can be kept significantly smaller than a length of the connecting rod.

By this combination of the cylinder with a positive, frictional and/or force-fit engagement with the eccentric coupling element, the stroke of the cylinder can be advantageously configured substantially smaller and be limited to a few millimeters, as this cylinder will then only be used for force generation, but is not needed for bridging a distance.

In order to compensate for deviations caused by the operation or the structure and irregular movements of the carrier unit, such as the intermediate level, the pressure cheek or the holder, for the movement of the plunger, medium can be selectively introduced into the force-generating means. Such deviations and irregular movements of the carrier unit can inadvertently occur due to elasticities or manufacture inaccuracies or are also deliberately pursued through structural advantages and e.g., design of the eccentricity. The occurring energetically marginal disadvantages are made up for by the predominant structural advantages and lower investment costs.

The method further provides that, immediately before the holder reaches the top initial position, the supply of the media in the cylinder is controlled or regulated for generating relative movements in the first wheel by means of the eccentric coupling element acting through a positive, frictional and/or force-fit engagement or in the cylinder for a temporarily stationary upper initial position of the holder.

Alternately, the carrier unit of the drawing device can be moved into the upper initial position by means of an externally induced force (spring or pneumatic cylinder) and the active connection can be implemented by means of the coupling element immediately before reaching the first position mentioned above.

When the downward movement of the holder begins, the work piece can be clamped between the holder and the upper tool part depending on the embodiment of the method according to the invention and then moved together with the plunger to the bottom dead center and then back to the upper initial position in an energy-saving manner in accordance with the object.

A force-generating element, such as a first force-generating means advantageously supports the downward movement of the holder and of the carrier unit and of the coupling element with a relatively small stroke.

The subsequent sequence of the method can then occur in accordance with the method in such a manner that after a release of the holder from the upper tool part occurring in the bottom dead center of the plunger, the holder remains in the bottom end position, the plunger is then moved upwards, wherein correspondingly supplied medium can directly or indirectly flow from the bottom chamber into the upper chamber in order for the pressure cheek to remain in position, wherein in the above first step) for an optimized motion sequence, a matched small volume of the medium is provided for releasing the holder, in a delayed speed-up, the work piece is released from the bottom tool part and the pressure cheek is moved together with holder to the upper initial position.

Based on the general disclosed steps of the method, the method is implemented as a variant of a translational active connection in such a manner that after a starting position of the intermediate level or the pressure cheek or the intermediate level and the pressure cheek at about ⅓ of the stroke of the plunger and with a tie rod moved downward, a tie of the tie rod impacts a piston of a locking unit connected with the intermediate level or the pressure cheek or the intermediate level and the pressure cheek, a volume of a medium enclosed in a cylinder is discharged in a controlled manner, the intermediate level or the pressure cheek or the intermediate level and the pressure cheek are moved downwards and pre-accelerated by means of a pressure thus built up, the intermediate level or the pressure cheek or the intermediate level and the pressure cheek are held against the gravitational acceleration and against the action of the locking unit by the action of the first force-generating means, the volume enclosed in a bottom chamber of a cylinder of the first force-generating means is thus reduced, the piston of the locking unit enters the cylinder of the locking unit and prepares the positive, frictional and/or force-fit connection with the tie rod and the positive, frictional and/or force-fit connection with the tie rod is then established by means of the cylinder, in the sequence toward the bottom dead center of the plunger, pressure is built up in a cylinder of at least one second force-generating means, by impinging a piston of the second force-generating means with pressure against the direction of movement of the intermediate level or the pressure cheek or the intermediate level and the pressure cheek in a regulated manner, a piston of the first force-generating means is moved downward during the process, the piston of the second force-generating means is relieved of the pressure in the bottom dead center and the active connection of the holder with the intermediate level or with the pressure cheek or with the intermediate level is released after the bottom end position of the holder and in the return sequence to the starting point, the tie rod is decoupled and moved freely in the locking unit, so that the intermediate lever or the pressure cheek or the intermediate level and the pressure cheek are held in the bottom position by the pressure from the upper chamber of the cylinder of the first force-generating means and then moved to the initial position.

In both variants of the method, the carrier unit, i.e., the intermediate level or the pressure cheek or the intermediate level and the pressure cheek or only the pressure cheek, is pre-accelerated by a value reduced by the value of the speed of the plunger, wherein the value of the speed can advantageously amount to 80% of the speed of the plunger.

The method is characterized in that a counterforce required for the forming process is applied on at least one floor of a respective component of the carrier unit by means of an energy-saving force flow, which is created and closed without power loss by the first force-generating means through its direct active connection by way of the components of the carrier unit, the tie rods, the plunger, the upper tool part, the work piece and the holder.

Thus the disadvantageous integration of connecting rods and of the actual drive device into the force flow known from the prior art while accepting power losses and great construction heights can be avoided and the required free space for the energy-saving sequences of the drawing device according to the invention can be surprisingly created as a consequence of the method.

With this method, an advantageous removal of the work piece from the bottom tool part may be carried out at the same time, by the holder being lifted upwards by the first force-generating means or second force-generating means or by temporary positive, frictional and/or force-fit frictional contact of the translational active connection.

Finally, the procedure is completed with regard to an automatic sequence by using the control and regulation device, if the recording, evaluation and control/alignment of one or more of the values or parameters of at least one of the dimensions or gradients a) of forming force of counterforces to be transmitted, b) of one of the positions of the work steps of forming, of the drive elements, of the positions of the plunger, of the holder, of the carrier unit, c) of a speed is realized in a computerized manner for the change from the closed to the released active connection or vice versa.

In order to implement a variant of the method, a press with a bottom drive comprises a drive device disposed in a bottom section, at least one plunger executing a stroke and receiving an upper tool part, with at least one acting tie rod of a drive train and at least one upper tool part corresponding to at least one bottom tool part disposed in the bottom section, wherein the drive device has at least one motor.

The press has a control and regulation device connecting at least one drive train and at least one motor. If there is more than one drive train, each one is associated to its own motor. In the bottom section, a shaft-type free space is provided and at least one drive train is connected to a drawing device.

In a press with a bottom drive for implementing the method with a mandatorily provided drawing device and a holder, at least one drive train of the drawing device is connected with a releasable rotatory or translational active connection in a coupled or decoupled manner in the change of the respective stroke.

The free space created in the bottom section as a consequence of the background analyzed in the introduction forms an interdependency. On the one hand it is a requirement for the disclosed features of the method and press variants according to the invention and on the other hand it can only be implemented by these features.

Thus it appears that this free space described as not feasible in the prior art described and criticized in the introduction has a surprisingly simple but not obvious reality and earns a key position for the implementation of both the method and the press according to the invention.

In a further development of the press, the drawing device, which according to the invention comprises a carrier unit with an intermediate level or a pressure cheek or the intermediate level and the pressure cheek or only the pressure cheek, is connected with the drive trains in a couplable or decouplable manner by means of the rotatory or translational active connection by positive, frictional and/or force-fit engagement in a variable causative position relative to the bottom section.

Under appropriate conditions, said position is also implementable so as to not be variable.

It is essential to the invention that in the press, the path of the drawing device is at least partially phase delayed, more specifically smaller relative to the path of the full stroke of the plunger.

At least one first force-generating means permitting the causative position relative to the bottom section and connected to the carrier unit is provided above or below.

At least one second force-generating means connected to the carrier unit serves for a constructional variant of the press.

The pressure cheek is disposed above or below the intermediate level and is drivable separately or with one of the drive trains, wherein it can also be arranged above the intermediate level in the bottom structure.

The active connection has at least one cylinder of the first force-generating means, whose piston rod is connected with the carrier unit configured only as a pressure cheek and its piston crown is connected with the drive device or vice versa, wherein the double-acting cylinder is configured to allow for the relative position of the pressure cheek to at least one element of the drive train by a pressure application from the piston rod or from the piston crown causing changes in the force/forces.

For the rotatory active connection, the piston crown is eccentrically coupled to a force and path generating first wheel of the drive device for at least one regulated or controlled sequence of motion sequences, of a pre-acceleration of the pressure cheek, of a pressurization or of a force-generation.

Said piston crown is connected via a second wheel to the first wheel, wherein said wheels form a gear of the rotatory active connection, to the drive device for at least one sequence of regulated or controlled motion sequences, of a pre-acceleration of the pressure cheek, of a pressure application or of a force generation.

An eccentrically hinged connecting rod of the tie rod can be advantageously attached to the first wheel.

The second wheel has an eccentric coupling element permitting a relative motion to the second wheel and acting by a positive, frictional and/or force-fit engagement.

In the rotatory active connection, the stroke of the plunger, a second stroke of the holder and a third stroke in the cylinder of the first force-generating means are designed according to the relation third stroke in the cylinder≥stroke of the plunger minus second stroke of the holder in accordance with an eccentricity existing in the second wheel in conjunction with the eccentric coupling element, wherein in the combination of the cylinder with the eccentric coupling element of the second wheel, the stroke in the cylinder of the cylinder now only serving for force generation is configured relatively small and a length of a connection of the first force-generating means between the pressure cheek and the eccentric coupling element is configured substantially smaller than a length of the connecting rod.

In a further constructional implementation variant according to the invention, which is analogue to the method variant using the translational active connection to the carrier unit, which in this case comprises the intermediate level or the pressure cheek or only the pressure cheek, a translational coupling or decoupling with at least one of the tie rods or at least one of the auxiliary tie rods of the drive device is formed.

This press embodiment comprises:

a) An area limited by a tie and a shoulder of a reduced diameter of the tie rod or of an auxiliary tie rod, b) At least one locking unit connected with the intermediate level or the pressure cheek or with the intermediate level and the pressure cheek with a piston, a cylinder including a first chamber and a second chamber as a housing and a locking element and c) a top chamber and a bottom chamber of the cylinder of the first force-generating means.

The tie rods of the press are frequently connected to the drive device with connecting rods.

The first force-generating means can be implemented as a coupling connecting rod, in order to connect the carrier unit to the drive device, which acts eccentrically, for the various implementation variants that do not have a translational coupling with the tie rods. In an implementation variant, this coupling connecting rod adopts the function of a telescopic extension mechanism.

The function of the carrier unit is reliably implemented by a parallel and linear guide in the free space of the bottom section.

The press is implementable with a rotatory coupling of the drive trains of the drive device in the free space or outside of it.

The force or path related or changing control/regulation required during the operating process is implemented by the control and regulation device.

The press implemented according to the invention is characterized as a whole by a closed force flow running through the first force-generating means, the carrier unit, the active connection to each drive train, the plunger, the upper tool part, the work piece and the holder, for an energy-saving operating process and for a compact design of the press.

WAYS OF IMPLEMENTING THE INVENTION

Figure 1:
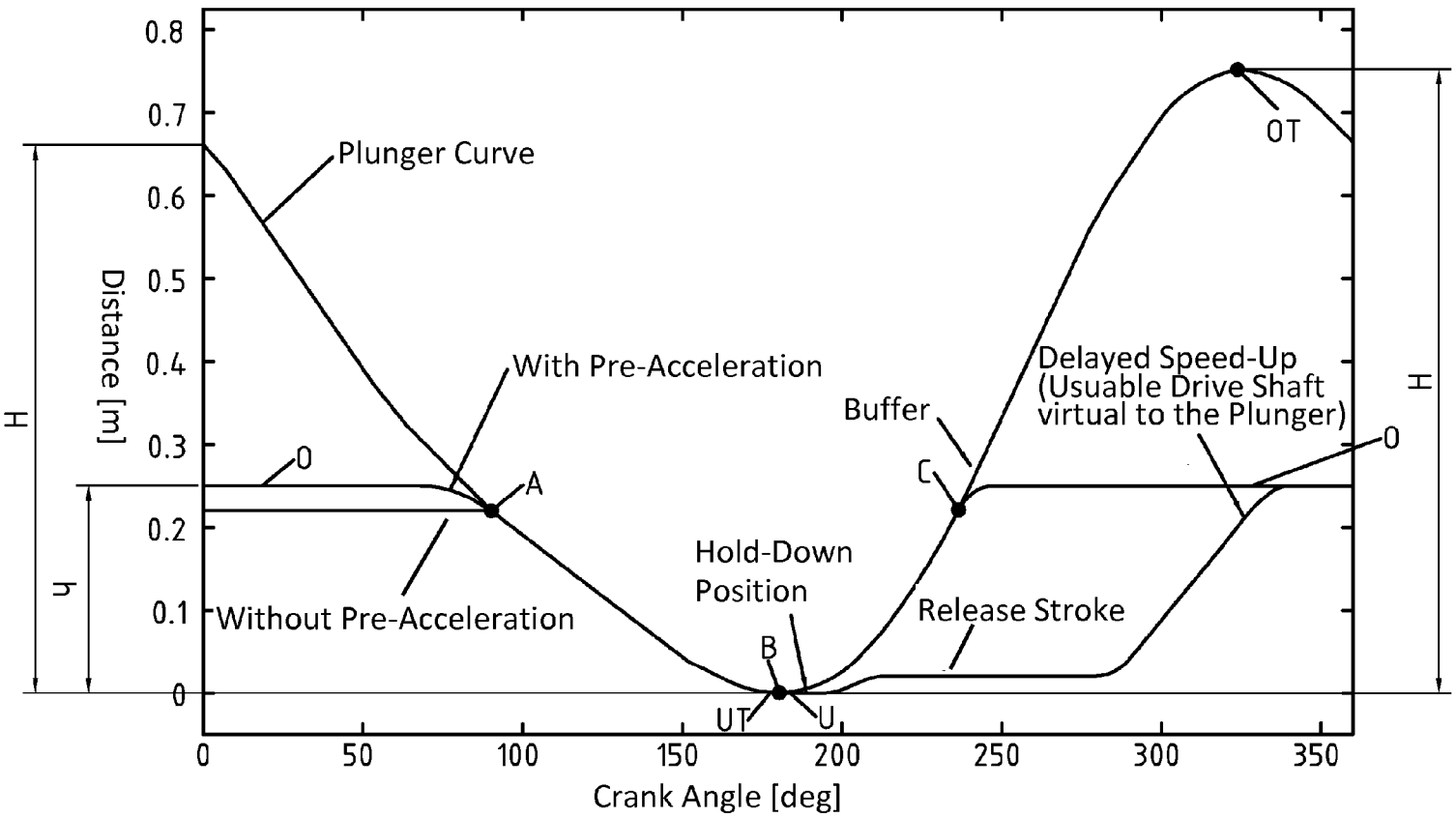
FIG. 1 shows a graphical representation of the principle of the process of the method according to the invention with the function of an interaction of the plunger with the drawing device that is novel with regard to the prior art.
Figure 2:
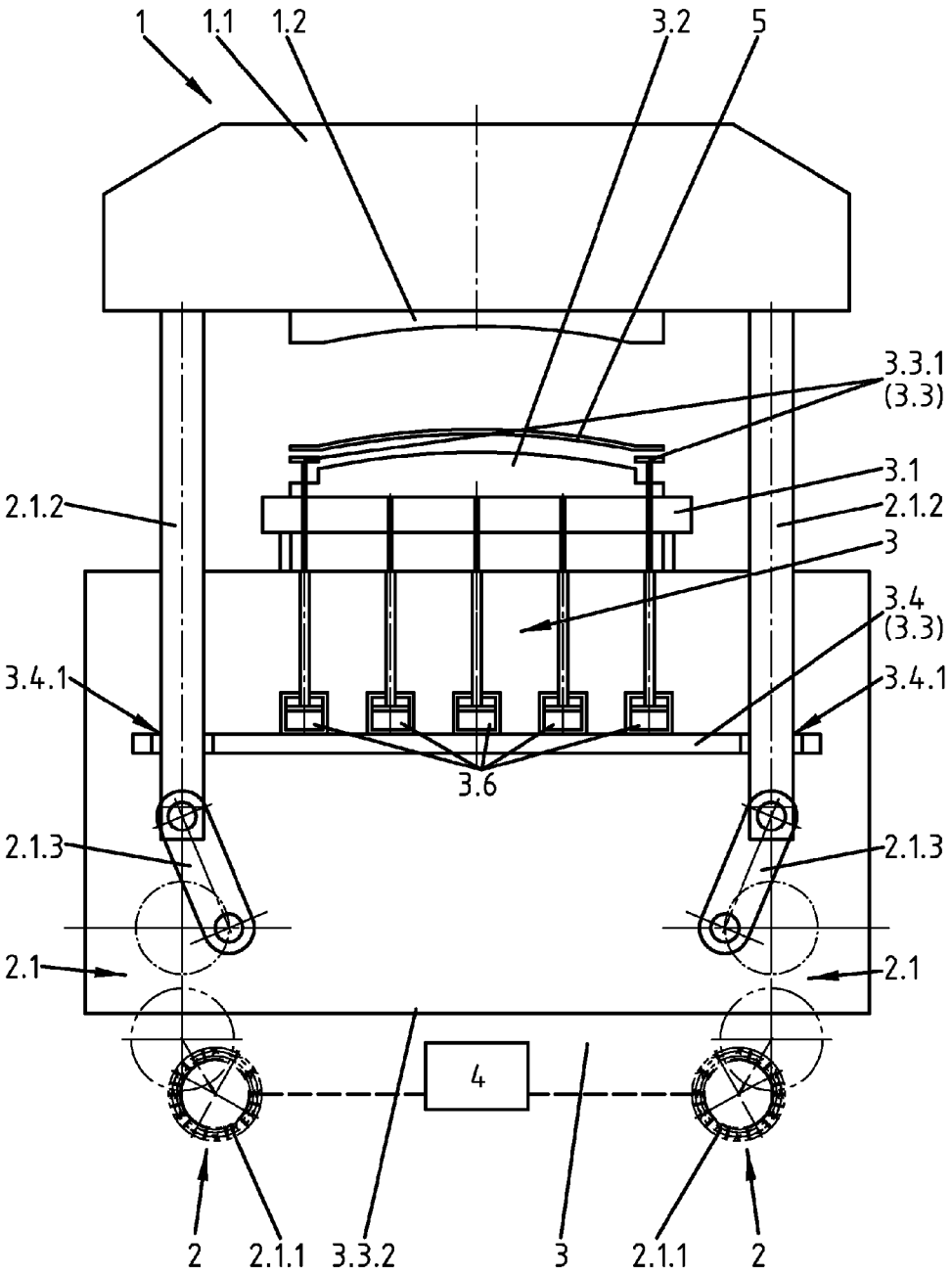
FIG. 2 shows the schematic representation of a constructional variant of the press according to the invention in a front view, FIG. 2.1 shows the schematic view of the modified force flow according to the invention as compared to the prior art.

FIG. 1 illustrates the graphical representation of coordinates of a path (m) and a crank angle (grd) of a curve of a plunger course and the principle of the method process according to the invention with pre-acceleration (in contrast to the mentioned method process without pre-acceleration according to the prior art) in the context of the new function of strokes H of a plunger course with a stroke h of a holder 3.3.1 (e.g., FIG. 2) of a drawing device 3.3 (e.g., FIG. 2).

- A plunger 1.1 (e.g., FIG. 2) operated in a downward stroke H from or from before or from after a top dead center OT onto a holder 3.3.1 (e.g., FIG. 2) movable in an upper initial position O,
- a first position A, toward which the holder 3.3.1 (e.g., FIG. 2), which is moveable downward in a stroke h, is pre-accelerated, namely immediately before the impact of a hit of the plunger 1.1 (e.g., FIG. 2) connected to an upper tool part 1.2 (e.g., FIG. 2) acting on it,
- a common active connection between one of the elements of drive trains 2.1 (e.g., FIG. 2) and an intermediate level 3.4 (e.g., FIG. 2) or a pressure cheek 3.5 (e.g., FIG. 3), operated in a closed manner toward a bottom dead center UT of the plunger 1.1 (FIG. 2) and toward a bottom end position U of the holder 3.3.1 (FIG. 2) as well as toward a second position B referred to as a "hold-down" position, namely after the upper tool part 1.2 (FIG. 2) has impacted on the holder 3.3.1 (FIG. 2);
- a releasable active connection between at least one of the elements of the drive trains 2.1 (FIG. 2) and of the drawing device 3.3 (e.g., FIG. 2) with the intermediate level 3.4 (FIG. 2) or the pressure cheek 3.5 (FIG. 3) or the intermediate level 3.4 (FIG. 2) and the pressure cheek 3.5 (FIG. 3), optionally referred to as "release stroke", after the plunger 1.1 (FIG. 2) has reached its bottom dead center UT, can be gathered from the curve progressions in FIG. 1.

Figure 3:
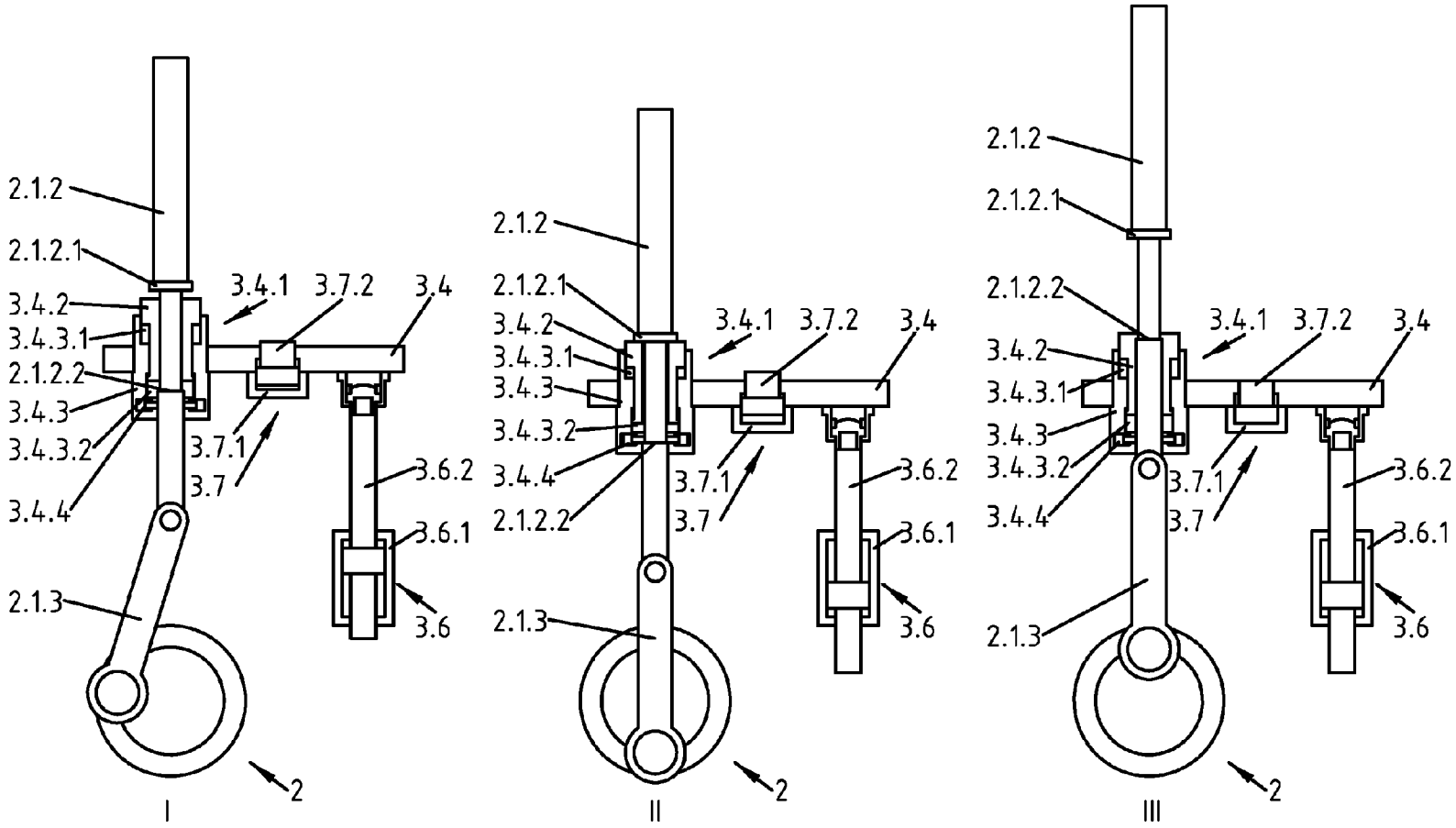
FIG. 3 shows a constructional variant of the press according to the invention with a first embodiment of a translational coupling.

It can further be gathered from FIG. 1 with reference e.g., to FIG. 2 and FIG. 3, that

- the upwards operated plunger 1.1 can be operated so that it is coupled with the upper tool part 1.2 and the intermediate level 3.4 or the pressure cheek 3.5 or the intermediate level 3.4 and the pressure cheek 3.5 after the bottom end position U,
- the active connection of the holder 3.3 either with the intermediate level 3.4 or the pressure cheek 3.5 or the intermediate level 3.4 and the pressure cheek 3.5 is released after the bottom end position U of the holder 3.3 and a so called "delayed speed-up" at least of the pressure cheek 3.5 for example can occur,
- the plunger 1.1 with the upper tool part 1.2 and the intermediate level 3.4 or the pressure cheek 3.5 or the intermediate level 3.4 and the pressure cheek 3.5, and the holder 3.3 can be separately operated toward an upper initial position O,
- the plunger 1.1 with the upper tool part 1.2 can be operated so that it is decoupled from the intermediate level 3.4 or the pressure cheek 3.5 or the intermediate level 3.4 and the pressure cheek 3.5 starting from a third position C immediately before reaching the upper initial position O of the holder 3.3.

Figure 7:
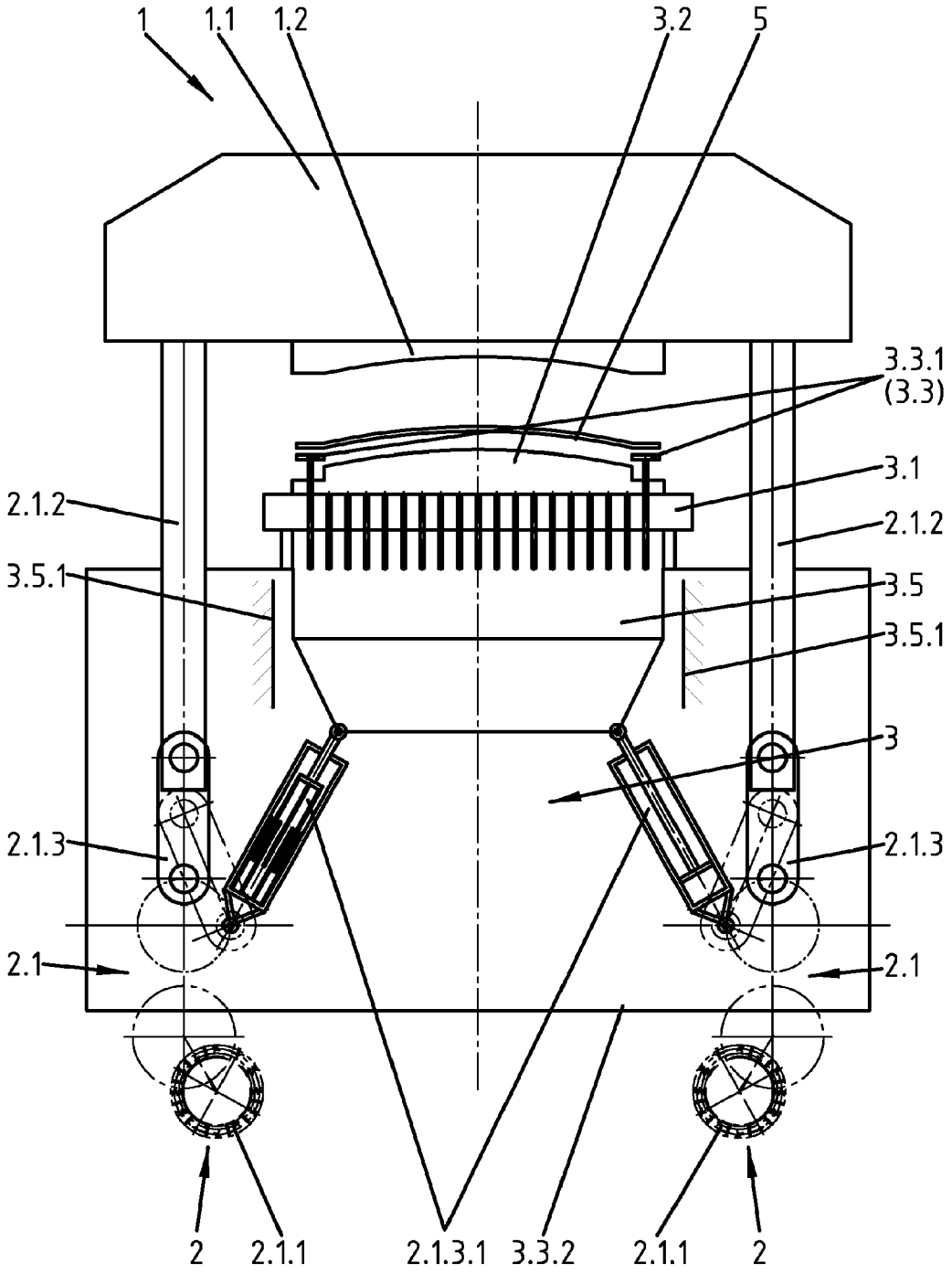
FIG. 7 shows a construction variant of the press according to the invention with a first hybrid variant of a rotatory and translational coupling using a coupling connecting rod and FIG. 7.1 shows a construction variant of the press according to the invention with a second hybrid variant of a rotatory and translational coupling using a coupling connecting rod.

According to this visual representation, the method can be understood in principle as follows:

In a press 1 implementable according to FIG. 2, FIG. 2.1, FIG. 3, FIG. 4, FIG. 5, FIG. 6.1, FIG. 6.2, FIG. 7 and/or FIG. 7.1, which has

- a drive device 2 disposed in a bottom section 3 and connected by way of drive trains 2.1 and
- at least one, plunger 1.1 executing the stroke H and receiving the upper tool part 1.2 with at least one tie rod 2.1.2 acting e.g., on its respectively outer end, which forms a work piece 5 with the at least one upper tool part 1.2 corresponding to at least one bottom tool part 3.2 disposed in the bottom section, by means of a drawing device 3.3 with a holder 3.3.1 for the work piece 5 to be machined, the motion sequence of the drawing device 3.3 and each drive train 2.1 of the drawing device 3.3 is operated in a coupled and decoupled manner in the change of the respective stroke H by means of a releasable active connection while keeping a free space 3.3.2 in the bottom section 3.

Thereby, during at least a partial travel of the downward stroke H, the drive train 2.1 is operated so that it is coupled to the drawing device 3.3 and during a partial travel of the upward stroke H, the drive train 2.1 is operated so that it is decoupled from the drawing device 3.3 and the drawing device 3.3 is thereby operated so that it does not reproduce or follow the path of the complete plunger stroke. This means that the path of the drawing device 3.3 with the holder 3.3.1 according to the stroke h is smaller than the path of the plunger 1.1 with the stroke H.

In the course of the stroke H, the active connection between at least one of drive elements of the drive train 2.1 and at least one of elements of a drawing device acting as a carrier unit with the intermediate level 3.4 or the pressure cheek 3.5 or the intermediate level 3.4 and the pressure cheek 3.5 or only the pressure cheek 3.5 of the drawing device 3.3 and operated by at least one first force-generating means 3.6, is alternately opened or closed by a force-fit or positive engagement and the position of the carrier unit during machining of the work piece 5 is varied.

Depending on at least one of the values or gradients of forming forces and paths to be transmitted, of one of the positions of the work steps of forming, of the elements of the drive trains 2.1, of the positions of the plunger 1.1, of the holder 3.3.1, of the carrier unit or of a speed, the active connection is closed or released, said functions being implemented by the control and regulation device 4.

The basic process of the method is completed in such a sequence of steps that a) the plunger 1.1 operated downward from or from before or from after a top dead center OT is moved toward a holder 3.3.1 located in an upper initial position O and the holder 3.3.1 in an active connection with the carrier unit is moved downward directly before the impact of a hit of the plunger 1.1 connected to the upper tool part 1.2 acting onto the holder 3.3.1, so that when the upper tool part 1.2 impacts on the holder 3.3.1, the holder is already moved in a pre-accelerated manner up to a first position A (FIG. 1) and the impact load is thus reduced and b) after the upper tool part 1.2 has impacted on the holder 3.3.1, the active connection between at least one of the elements of the drive trains 2.1 and the intermediate level 3.4 or the pressure cheek 3.5 or the intermediate level 3.4 and the pressure cheek 3.5 is closed and these elements are moved up to a bottom end position U (FIG. 1) of the holder 3.3.1 and the plunger 1.1 with the upper tool part 1.2 are moved together up to its bottom dead center UT (FIG. 1) and to a second position B (FIG. 1), wherein c) alternately, the active connection between at least one of the elements of the drive trains 2.1 and the drawing device 3.3 with the intermediate level 3.4 or the pressure cheek 3.5 or the intermediate level 3.4 and the pressure cheek 3.5 is released together, once the plunger 1.1 has reached its bottom dead center UT (FIG. 1).

The method thereby integrates at least one of the following sequences:

the upwards operated plunger 1.1 is operated so that it is coupled with the upper tool part 1.2 and the intermediate level 3.4 or the pressure cheek 3.5 or the intermediate level 3.4 and the pressure cheek 3.5 after the bottom end position U, the active connection of the holder 3.3.1 either with the intermediate level 3.4 or the pressure cheek 3.5 or the intermediate level 3.4 and the pressure cheek 3.5 is released after the bottom end position U of the holder 3.3.1, the plunger 1.1 with the upper tool part 1.2 and the intermediate level 3.4 or the pressure cheek 3.5 or the intermediate level 3.4 and the pressure cheek 3.5 and the holder 3.3 are operated separately toward their upper initial position O, the plunger 1.1 with the upper tool part 1.2 is operated so that it is decoupled from the intermediate level 3.4 or the pressure cheek 3.5 or the intermediate level 3.4 and the pressure cheek 3.5, starting from a third position C (FIG. 1) immediately before reaching the upper initial position O of the holder 3.3.

The method is preferably implemented with a rotatory active connection of the press 1 shown in FIG. 6.1 and FIG. 6.2. The process steps here occur in such a manner that 1. first, when the plunger 1.1 is in an initial position corresponding to the top dead center OT (FIG. 1) and the pressure cheek 3.5 and holder 3.3.1 are in an upper initial position O (FIG. 1), a piston rod 3.6.1.3 is partially extended in a cylinder 3.6.1 of the first force-generating means 3.6 and the cylinder 3.6.1 is in an intermediate position,
2. when the plunger 1.1 initiates a downward movement, an engagement occurs by way of the tie rod 2.1.2 with a first wheel 2.3.1 of a gear comprising a second wheel 2.3.2, wherein said second wheel 2.3.2 comprises an eccentric coupling element 2.3.2.1 acting by a positive or force-fit engagement and allowing for a movement relative to the second wheel 2.3.2, by means of a connecting rod 2.1.3 eccentrically linked to the first wheel 2.3.1, and the holder 3.3.1 thereby remains in its top initial position O (FIG. 1), wherein a bottom chamber 3.6.1.2 in the cylinder 3.6.1 is loaded with a controlled or regulated medium, so that the cylinder 3.6.1 extends according to the movement of the pair of wheels 2.3.1, 2.3.2 and the holder 3.3.1 thus remains in the top initial position O (FIG. 1),
3. when the holder 3.3.1 begins to pre-accelerate toward the first position A (FIG. 1), the volume flow of the medium to the bottom chamber 3.6.1.2 of the cylinder 3.6 is reduced shortly before the plunger 1.1 impacts on the holder 3.3.1, and a downward movement of the holder 3.3.1 is thus initiated, independently of whether medium is correspondingly supplied into an upper chamber 3.6.1.1 or not,
4. the plunger 1.1 in the first position A (FIG. 1) then impacts on the holder 3.3.3 and a pressure is generated in the bottom chamber 3.6.1.2 of the cylinder 3.6.1 and an action by means of the force of the cylinder 3.6.1 is transmitted by way of the pressure cheek 3.5 to the holder 3.3.1, which rests on the upper tool part 1.2 moving downward, and
5. the work piece 5 to be machined is clamped and formed in an energy-saving manner by means of a closed force flow K visible in FIG. 2. 1 to the right of the center line, starting at cylinder 3.6.1, continuing along the pressure cheek 3.5, the holder 3.3.1, the upper tool part 1.2, the plunger 1.1, the tie rods 2.1.2, the connecting rods 2.1.3 as well as the first wheel 2.3.1 and the second wheel 2.3.2—as shown in FIGS. 6.1 and 6.2, wherein the forming process occurs up to the bottom dead center UT (FIG. 1) in the cylinder 3.6.1 by active control/regulation of the pressure, independently of whether volume of the medium is supplied or not.

The closed force flow K essential to the invention as shown in FIG. 2.1 to the right of the center line illustrates more specifically the beneficial effects created by the invention as compared to the costly force flow in terms of energy and components shown to the left of the center line according to the prior art as analyzed in the introduction.

Thus, the drawing device 3.3 is operated so that it is couplable or decouplable with the complete stroke H of the plunger 1.1, wherein the stroke H of the plunger 1.1 and the drawing device 3 are always operated in a closed force flow.

Due to the modified method sequences and constructive changes in the press with a bottom drive, the stroke H (FIG. 1) of the plunger 1.1, the stroke h (FIG. 1) of the holder 3.3.1 and a stroke $H_{Zyl}$ (FIG. 6.1 and FIG. 6.2) in the cylinder 3.6.1 are now controlled according to the relation $h_{Xyl} \geq H-h$, in accordance with an eccentricity E, E=h/2 (FIG. 6.1 and FIG. 6.2), existing in the second wheel 2.3.2 in conjunction with the eccentric coupling element 2.3.2.1 acting by positive, frictional and/or force-fit engagement. In the combination of the cylinder 3.6.1 with the eccentric coupling element 2.3.2.1 of the second wheel 2.3.2, the stroke $h_{Zyl}$ of the cylinder 3.6.1, which serves only for building up a force, is relatively small. A length $l_1$ (FIG. 6.1 and FIG. 6.2) of a connection of the first force-generating means 3.6 between the pressure cheek 3.5 and the eccentric coupling element 2.3.2.1 can thus be advantageously kept significantly smaller than a length 12 (FIG. 6.1 and FIG. 6.2) of the connecting rod 2.1.3.

In order to compensate for deviations caused by the operation or the structure and irregular movements of the carrier unit, the intermediate level 3.4, the pressure cheek 3.5 or the holder 3.3.1 for the movement of the plunger 1.1, medium can be selectively introduced into the first force-generating means 3.6.

Immediately before the holder 3.3.1 reaches the upper initial position O (FIG. 1), the supply of the medium into the cylinder 3.6.1 is controlled or regulated for generating relative movements in the first wheel 2.3.1 by means of the eccentric coupling element 2.3.2.1 or in the cylinder 3.6.1 for a temporarily stationary upper initial position O the holder 3.3.1.

When the holder 3.3.1 begins moving downward, the work piece 5 is clamped between the holder 3.3.1 and the upper tool part 1.2 and moved together with the plunger 1.1 in an energy-saving manner toward the bottom dead center UT and then moved back to the upper initial position O. The downward movement is thereby supported by the force-generating first means 3.6 with a relatively small stroke.

The method corresponding to the rotatory active connection ends by 1. the holder 3.3.1 remaining in the bottom end position U after a release of the holder 3.3.1 from the upper tool part 1.2 has occurred in the bottom dead center UT of the plunger 1.1,
2. the plunger 1.1 being then moved upwards, wherein correspondingly supplied medium can directly or indirectly flow from the bottom chamber 3.6.1.2 into the upper chamber 3.6.1.1 in order for the pressure cheek 3.5 to remain in position, wherein
3. for step (a) an adjusted volume of the medium being provided for an optimized motion sequence and after releasing the holder 3.3.1 the volume of the medium in a mode of a delayed speed-up, the pressure cheek 3.5 is lifted to the upper initial position O.

The specific steps and alternative implementation of a translational active connection with the phases I, II, III in a first implementation variant are explained as follows based on FIG. 3:

a) After an initial position of the intermediate level 3.4 at approximately ⅓ of the stroke H (FIG. 1) of the plunger 1.1 (FIG. 2) shown in phase I and with the tie rod 2.1.2 moving downward, in phase II, a tie 2.1.2.1 of the tie rod 2.1.2 impacts on a piston 3.4.2 of a locking unit 3.4.1 connected to the intermediate level 3.4, a volume of a medium enclosed in a cylinder 3.4.3 is discharged in a controlled manner, the intermediate level 3.4 is moved downward and pre-accelerated by means of a pressure thus built up, the intermediate level 3.4 is held by the action of the first force-generating element 3.6 against the gravitational acceleration and against the action of the locking unit 3.4.1, the volume enclosed in a bottom chamber 3.6.1.2 of the cylinder 3.6.1 of the force-generating means 3.6 is thereby reduced, the piston 3.4.2 of the locking unit 3.4.1 penetrates into the cylinder 3.4.3 of the locking unit 3.4.1, whereby the connection with the tie rod 2.1.2 is prepared and the connection with the tie rod (2.1.2) is then created by means of the cylinder 3.4.3, b) in the operating sequence toward the bottom dead center UT (FIG. 1) of the plunger 1.1, a pressure is built up in a cylinder 3.7.1 of a second force-generating means 3.7 by pressurizing a piston 3.7.2 of the second force-generating means 3.7 against the direction of movement of the intermediate level 3.4 in a regulated manner, during the operating sequence, the piston 3.6.2 of the first force-generating means 3.6 is moved downwards, the piston 3.7.2 of the second force-generating means 3.7 is relieved from the pressure in the bottom dead center UT and the active connection of the holder 3.3.1 (FIG. 2) with the intermediate level 3.4 is released after the bottom end position U of the holder 3.3.1 (FIG. 2) and c) in the return sequence to the initial position, in accordance with Phase III, the tie rod 2.1.2 is freely moved in the locking unit 3.4.1, so that the intermediate level 3.4 is held in the bottom position U (FIG. 1) by the pressure from the upper chamber 3.6.1.1 of the cylinder 3.6.1 of the first force-generating means 3.6 and then moved to the initial position A.

An alternative solution is also explainable based on FIG. 3 according to which the carrier unit of the drawing device 3.3 (e.g., FIG. 2) such as the intermediate level 3.4 can be moved to the upper initial position by means of an external force induced by a spring or a pneumatic cylinder, analog to the action of the first force-generating means 3.6 and the active connection can be implemented immediately before reaching the first position by means of a coupling element analogue to the locking unit 3.4.1.

Figure 4:
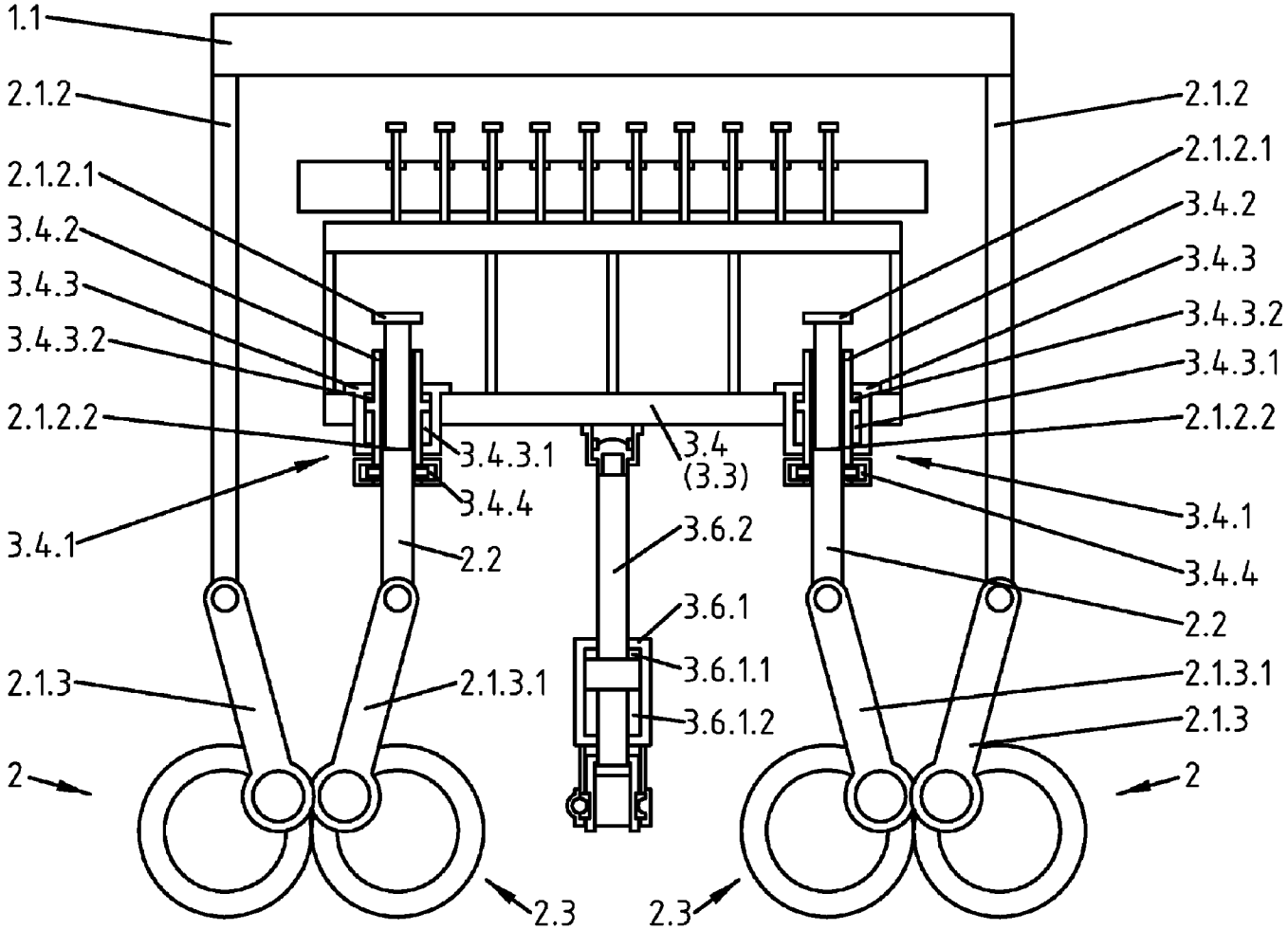
FIG. 4 shows a constructional variant of the press according to the invention with a second embodiment of a translational coupling.

A second construction variant of the press according to the invention with a translatorily coupled active connection is shown in FIG. 4. In contrast to the first construction variant, an auxiliary tie rod 2.2 attached to respectively one coupling connecting rod 2.1.3.1 of the rotatory coupling 2.3 with the connecting rod 2.1.3 and the tie rod 2.1.2 here assumes the features which function similarly to the intermediate level 3.4 and the locking unit 3.4.1. Hereby, only the first force-generating means 3.6 is required as a consequence of the implementation and action of the rotatory coupling 2.3.

Figure 5:
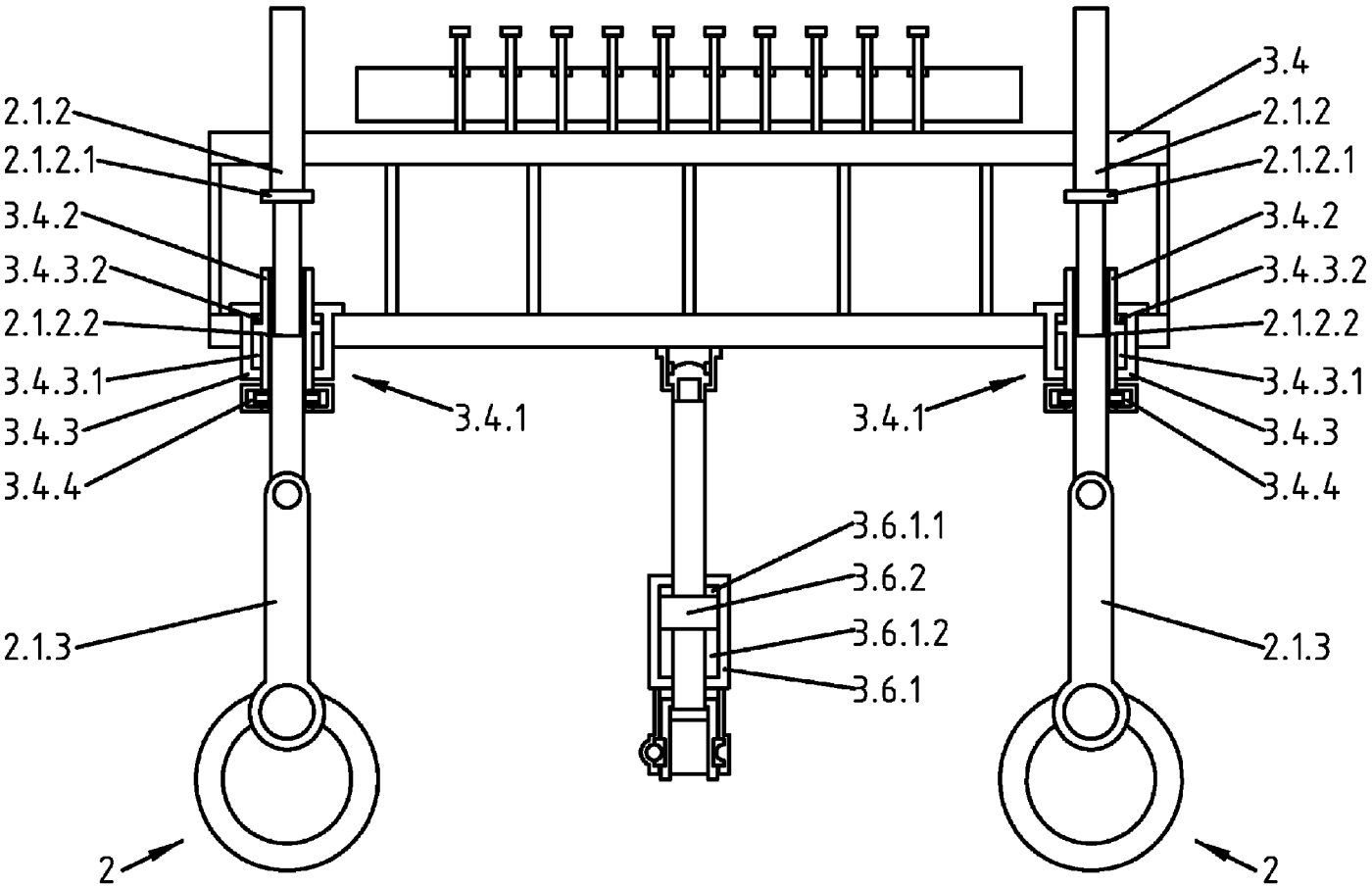
FIG. 5 shows a constructional variant of the press according to the invention with a third embodiment of a translational coupling, FIG. 6.1 shows a representation of a constructional variant of the press according to the invention with the embodiment of a rotatory coupling in the "top dead center OT" of the plunger, FIG. 6.2 shows the constructional variant according to FIG. 6.1 in a motion phase of the plunger toward the "bottom dead center UT" of the plunger.

A third construction variant of the press 1 according to the invention with a translational coupling is shown in FIG. 5 which is similar to the first construction variant but where only the first force-generating means 3.6 is necessary, wherein the function of the second force-generating means 3.7 apparent in FIG. 3 is carried out by the pressurization of the piston 3.4.2 in the locking unit acting in the same way as in FIG. 3.

In general, the method is advantageously implemented in such a manner that the carrier unit is pre-accelerated by a value reduced by the value of the speed of the plunger 1.1, said value amounting preferably to 80% of the speed of the plunger 1.1.

A counterforce required for the forming process is applied onto a floor of the carrier unit, such as an intermediate level 3.4 and/or a pressure cheek 3.5, by means of the energy-saving force flow K apparent in FIG. 2.1, said force flow K being created and closed without power loss by the first force-generating means 3.6 through its direct interaction with the components of the carrier unit, the tie rods 2.1.2, the plunger 1.1, the upper tool part 1.2, the work piece 5 and the holder 3.3.

In order to remove the work piece 5 from the bottom tool part 3.2, the holder 3.3.1 is lifted by the first force-generating means 3.6 or second force-generating means 3.7 or by temporary closure of the positive, frictional and/or force-fit active connection.

With the control and regulation device 4 integrated in FIG. 2 for recording, evaluating and controlling/aligning, values or parameters for at least one of the dimensions or gradients of forming forces, counterforces or of a speed to be transmitted or of one of the positions of the work steps of forming, of the elements of the drive device 2.1, of the positions of the plunger 1.1, of the holder 3.3, or of the carrier unit, are evaluated for the change from the closed to the released active connection or vice versa.

A so-called hybrid version of the press 1 according to invention with a rotatory and translational coupling using a coupling connecting rod 2.1.3.1 is shown in FIG. 7, in which a telescopic extension mechanism is provided in the coupling connecting rod 2.1.3.1 hinged to the connecting rod 2.1.3. The eccentric rotatory drive transmitted by the drive device 2 (as shown also in FIG. 2, FIG. 2.1, FIG. 4, FIG. 5, FIG. 6.1, FIG. 6.2) via the connecting rods 2.1.3 to the tie rods 2.1.2 is transformed into an expedient translational active connection with the components of the drawing device 3.1 by the action of the telescopic extension mechanism of a double acting cylinder in the connecting rod 2.1.3.1. As defined by the inventive concept, the active connection can also be operated in a coupled and/or decoupled manner in the change of the respective stroke H. In this hybrid version, the coupling connecting rod 2.1.3.1 is schematically shown to the left of the center line in terms of a frictional-translational active connection and to the right of the center line in terms of a hydraulic-force-fit translational active connection.

Another hybrid variant of a rotatory and translational coupling using a coupling connecting rod 2.1.3.1 is symbolically shown in FIG. 7.1. In the same way as in FIG. 6.1 and FIG. 6.2, the eccentric coupling element 2.3.2.1 is in turn integrated here into the (quasi-second) wheel 2.3.2 so as to be movable relative to it, in order to be able to operate the active connection in the change of the respective stroke H in a coupled and/or uncoupled manner.

The press 1 is implemented with a parallel and linear guide 3.5.1 schematically shown in FIG. 6.1, FIG. 6.2, FIG. 7 and FIG. 7.1 for the carrier unit with intermediate level 3.4 or pressure cheek 3.5 or intermediate level 3.4 and pressure cheek or only with pressure cheek in the free space 3.3.2 of the bottom section 3.

In general, the rotatory coupling 2.3 of the drive trains 2.1 of the drive device 2 shown in FIG. 4 is accommodated in the free space 3.3.2 or outside of it, wherein, in this case a motor 2.1.1 not shown with a connecting control and regulation device 4 not shown can be used.

INDUSTRIAL APPLICABILITY

In accordance with the object, a new method for operating a press with a bottom drive as well as a new press are created, wherein a functional, technologically usable area—on the one hand, in technological steps of drawing with a drawing device and energy-efficient drive kinematics and on the other hand in technological steps of the removal of cutting waste—is created in the bottom structure. Since the press becomes compactly implementable and economically operable as a large press and as a transfer press in transfer lines with energy-optimized performance data, the method and the press with its presented variants according to the invention can implement economic and energetic benefits more specifically for operators of generic presses as compared to previous presses.

LIST OF REFERENCE SIGNS

1=press
1.1=plunger
1.2=upper tool part
2=drive device
2.1=drive train
2.1.1=motor
2.1.2=tie rod
2.1.2.1=tie
2.1.2.2=shoulder
2.1.3=connecting rod
2.1.3.1=coupling connecting rod
2.2=auxiliary connecting rod
2.3=rotatory coupling
2.3.1=first wheel
2.3.2=second wheel
2.3.2.1=eccentric coupling element
3=bottom section
3.1=table
3.2=bottom tool part
3.3=drawing device
3.3.1=holder
3.3.2=free space
3.4=intermediate level
3.4.1=locking unit
3.4.2=piston
3.4.3=cylinder (housing)
3.4.3.1=first chamber
3.4.3.2=second chamber
3.4.4=locking element
3.5=pressure cheek
3.5.1=parallel and linear guide
3.6=first force-generating means
3.6.1=cylinder
3.6.1.1=upper chamber
3.6.1.2=bottom chamber
3.6.1.3=piston rod
3.6.1.4=piston crown
3.6.2=piston
3.7=second force-generating means
3.7.1=cylinder
3.7.2=piston
4=control and regulation device
5=work piece
A=first position
B=second position
C=third position
E=eccentricity
H=stroke of the plunger 1.1
h=stroke of the holder 3.3.1
$H_{Zyl}$=stroke of the cylinder 3.6.1
K=force flow
OT=top dead center of the plunger 1.1
UT=bottom dead center of the plunger 1.1
O=upper initial position of the holder 3.3.1
U=bottom end position of the holder 3.3.1

The invention claimed is:

1. A method for operating a press, wherein a work piece is machined or formed by:

a drive device arranged in a bottom section, and at least one plunger configured to execute a stroke and to receive at least one upper tool part which comprises at least one acting tie rod of at least one drive train, the at least one upper tool part corresponding to at least one bottom tool part being arranged in the bottom section, and a drawing device comprising a holder, the method comprising:

driving the drive device by at least one motor as a linear and/or a rotary direct drive; and when using the drawing device, operating a path of the drive device so that the drive device is couplable or decouplable from a complete stroke of the at least one plunger so that the stroke of the at least one plunger and the drawing device are always operated in a closed force flow; and operating the at least one drive train so that the at least one drive train is coupled or decoupled to the drawing device by a releasable active connection which is at least one of rotatory and translational in a change of a respective stroke.

2. The method as recited in claim 1, wherein the at least one drive train is operated by a control and regulation device which connects to the least one motor.

3. The method as recited in claim 1, wherein each of the at least one drive train is operated by a respective one of the at least one motor.

4. The method as recited in claim 1, wherein the at least one drive train is operated while keeping a shaft-type free space arranged in the bottom section.

5. The method as recited in claim 1, wherein the at least one drive train operates the drawing device.

6. The method as recited in claim 1, wherein, the at least one drive train is coupled to the drawing device during at least a partial path of a downward stroke, and the at least one drive train and is decoupled from the drawing device during at least a partial path of an upward stroke.

7. The method as recited in claim 6, wherein the at least one drawing device is operated so that it does not reproduce or follow a path of a complete stroke of the at least one plunger.

8. The method as recited in claim 1, wherein, the active connection is between at least one of drive elements of the drive train and at least one of elements of the drawing device so as to act as a carrier unit with an intermediate level or a pressure cheek or an intermediate level and the pressure cheek or only the pressure cheek and is operated by at least one first force-generating means which is closed or released in the change by a positive or frictional or force-fit engagement, and a position of the carrier unit is varied during a forming of the work piece.

9. The method as recited in claim 1, wherein, the active connection is between at least one of drive elements of the drive train and at least one of elements of the drawing device so as to act as a carrier unit with an intermediate level or a pressure cheek or an intermediate level and the pressure cheek or only the pressure cheek and is operated by at least one first force-generating means which is closed or released in the change by a positive or frictional or force-fit engagement, and a position of the carrier unit relative to the holder is not varied.

10. The method as recited in claim 1, wherein the active connection is closed or released depending on at least one of values or gradients of forming forces, speed or paths to be transmitted, or of one of positions of work steps of a forming, of drive elements, of positions of the at least one plunger, of the holder, of the carrier unit or of a speed.

11. The method as recited in claim 8, wherein, a) the plunger operated downward from or from before or from after a top dead center is moved toward the holder located in an upper initial position and the holder in an active connection with the carrier unit is moved downward immediately before an impact of a hit of the at least one plunger connected to the upper tool part acting onto the holder, so that, when the upper tool part impacts on the holder, the holder is already moved in a pre-accelerated manner up to a first position so as to reduce an impact load, b) after the upper tool part has impacted on the holder, closing the active connection between at least one of the elements of the drive train and the intermediate level or the pressure cheek or the intermediate level and the pressure cheek, and moving these elements up to a bottom end position of the holder, and the at least one plunger, with the upper tool part, are moved together up to its bottom dead center and to a second position, and c) releasing the active connection between at least one of the elements of the drive train and the drawing device with the intermediate level or the pressure cheek or the intermediate level and the pressure cheek once the at least one plunger has reached its bottom dead center.

12. The method as recited in claim 8, wherein at least one of the following sequences is applied:

a) operating the at least one plunger in an upward stroke so that it is coupled with the upper tool part and the intermediate level or the pressure cheek or the intermediate level and the pressure cheek after the bottom end position, b) releasing the active connection of the holder either with the intermediate level or the pressure cheek or the intermediate level and the pressure cheek after the bottom end position of the holder, c) separately operating the at least one plunger with the upper tool part and the intermediate level or the pressure cheek or the intermediate level and the pressure cheek and the holder toward their upper initial position, and d) operating the at least one plunger with the upper tool part so that it is decoupled from the intermediate level or the pressure cheek or the intermediate level and the pressure cheek starting from a third position immediately before reaching the upper initial position of the holder.

13. The method as recited in claim 1, wherein, a) first, when the at least one plunger is in an initial position corresponding to a top dead center and a pressure cheek and the holder are in an upper initial position, a first force-generating piston rod is partially extended in a first force-generating cylinder of a first force-generating means and the first force-generating cylinder is in an intermediate position, b) when the at least one plunger initiates a downward movement, an engagement occurs by way of the at least one acting tie rod with a first wheel of a gear of a rotatory coupling comprising a second wheel, wherein the second wheel comprises an eccentric coupling element which acts via a positive, frictional or force-fit engagement so as to allow for a movement relative to the second wheel, via a connecting rod eccentrically linked to the first wheel, and the holder thereby remains in its top initial position, wherein a bottom chamber in the first force-generating cylinder is loaded with a controlled or regulated medium, so that the first force-generating cylinder extends according to a movement of the first wheel and the second wheel and the holder thus remains in the top initial position, c) when the holder begins to pre-accelerate toward a first position, a volume flow of the controlled or regulated medium to the bottom chamber of the first force-generating cylinder is reduced shortly before the at least one plunger impacts on the holder so as to initate a downward movement of the holder independently of whether the controlled or regulated medium is correspondingly supplied into an upper chamber or not, d) the at least one plunger in the first position then impacts on the holder so as to generate a pressure in the bottom chamber of the first force-generating cylinder and to transmit an action (force) of the first force-generating cylinder via the pressure cheek to the holder, which rests on the upper tool part moving downward, and e) the work piece to be machined is clamped and formed in an energy-saving manner by a closed force flow, starting at the first force-generating cylinder, continuing along the pressure cheek, the holder, the upper tool part, the at least one plunger, the at least one acting tie rod, the connecting rod, the first wheel, and the second wheel, wherein a forming process occurs up to a bottom dead center in the first force-generating cylinder by an active control/regulation of the pressure, independently of whether a volume of the controlled or regulated medium is supplied or not.

14. The method as recited in claim 13, wherein the stroke (H) of the at least one plunger, a stroke (h) of the holder, and a stroke (hZyl) in the first force-generating cylinder are controlled according to a relation hZyl≥H−h, in accordance with an eccentricity (E) E=H/2 existing in the second wheel in connection with the eccentric coupling element acting by a positive, frictional or force-fit engagement, so that, in a combination of the first force-generating cylinder with the eccentric coupling element of the second wheel, the stroke of the first force-generating cylinder, now serving only for a force generation, becomes relatively small and a length of a connection of the first force-generating means between the pressure cheek and the eccentric coupling element can be kept smaller than a length of the connecting rod.

15. The method as recited in claim 14, wherein, in order to compensate for deviations caused by an operation or a structure and irregular movements of a carrier unit, an intermediate level, the pressure cheek, or the holder, the controlled or regulated medium is selectively introducable into the first force-generating means for the movement of the at least one plunger.

16. The method as recited in claim 15, wherein, immediately before the holder reaches an upper initial position, a supply of the controlled or regulated medium into the first force-generating cylinder is controlled or regulated so as to generate relative movements in the first wheel via the eccentric coupling element or in the first force-generating cylinder for a temporarily stationary upper initial position the holder.

17. The method as recited in claim 16, wherein, via an externally induced force, the carrier unit of the drawing device is moved into the upper initial position and the active connection is formed by the eccentric coupling element immediately before reaching the first position.

18. The method as recited in claim 17, wherein, when the holder begins to move downward, the work piece is clamped between the holder and the upper tool part and is moved in an energy-saving manner together with the at least one plunger to the bottom dead center and then back to the upper initial position.

19. The method as recited in claim 13, wherein a first force-inducing element supports the downward movement of the holder and of the carrier unit and the coupling element by a small stroke.

20. The method as recited in claim 19, wherein, a) the holder remains in a bottom end position after a release of the holder from the upper tool part has occurred in the bottom dead center of the at least one plunger, and b) the at least one plunger is then moved upwards, wherein correspondingly, supplied controlled or regulated medium can directly or indirectly flow from the bottom chamber into the upper chamber in order for the pressure cheek to remain in position, wherein, c) in step a), a matched small volume of the controlled or regulated medium is provided to release the holder, the work piece being released from the bottom tool part in a delayed speed-up, and the pressure cheek being moved together with the holder to the upper initial position.

21. The method as recited in claim 20, wherein after a starting position of an intermediate level or the pressure cheek or the intermediate level and the pressure cheek at about ⅓ of the stroke of the at least one plunger and with the at least one acting tie rod moved downward, a tie of the at least one acting tie rod impacts a locking unit piston of a locking unit which is connected with the intermediate level or the pressure cheek or the intermediate level and the pressure cheek, a volume of a medium enclosed in a locking unit cylinder is discharged in a controlled manner, the intermediate level or the pressure cheek or the intermediate level and the pressure cheek are moved downwards and pre-accelerated by a pressure thus built up, the intermediate level or the pressure cheek or the intermediate level and the pressure cheek are held against a gravitational acceleration and against an action of the locking unit by an action of the first force-generating means, the volume enclosed in a bottom chamber of the first force-generating means cylinder is thus reduced, the locking unit piston enters the locking unit cylinder and prepares the positive, frictional and/or force-fit connection with the at least one acting tie rod and the positive, frictional and/or force-fit connection with the at least one acting tie rod is then established via the locking unit cylinder, in the sequence toward the bottom dead center of the at least one plunger, pressure is built up in a second force-generating cylinder of at least one second force-generating means, by impinging a second force-generating piston of the second force-generating means with pressure against a direction of a movement of the intermediate level or the pressure cheek or the intermediate level and the pressure cheek in a regulated manner, a first force-generating means piston of the first force-generating means is moved downward during the process, the second force-generating means piston is relieved of the pressure in the bottom dead center and the active connection of the holder with the intermediate level or with the pressure cheek or with the intermediate level and the pressure cheek is released after the bottom end position of the holder, and in the return sequence to the initial position, the at least one acting tie rod is moved freely in the locking unit so that the intermediate level or the pressure cheek or the intermediate level and the pressure cheek are held in the bottom position by the pressure from the upper chamber of the first force-generating means cylinder and then moved to the initial position.

22. The method as recited in claim 21, wherein the carrier unit is pre-accelerated by a value which is reduced by a value of a speed of the at least one plunger.

23. The method as recited in claim 22, wherein the value of the speed of the carrier unit is 80% of the speed of the at least one plunger.

24. The method as recited in claim 23, wherein a counterforce required for the forming process is applied on at least one floor comprising the intermediate level and/or the pressure cheek of the carrier unit by an energy-saving force flow which is implemented and closed without a power loss by the first force-generating means through its direct active connection with the intermediate level and/or the pressure cheek of the carrier unit by a positive or frictional or force-fit active connection with the at least one acting tie rod, the at least one plunger, the upper tool part, the work piece, and the holder.

25. The method as recited in claim 24, wherein, for a removal of the work piece from the bottom tool part, the holder is lifted by the first force-generating means or by second force-generating means or by a temporary positive or frictional or force-fit active connection.

26. The method as recited in claim 20, wherein the control and regulation device is used for recording, evaluating and controlling/aligning at least one of the values or parameters of at least one of the dimensions or gradients, of forming forces, counterforces or a speed to be transmitted, or of one of the positions of the work steps of forming, of the drive elements, of the positions of the at least one plunger, of the holder, or of the carrier unit, so as to change from a closed active connection to a released active connection or vice versa.

27. A press with a bottom drive, the press comprising:

a drive device as a linear and/or a rotary direct drive arranged in a bottom section;

a plunger configured to execute a stroke and to receive an upper tool part which comprises at least one acting tie rod of at least one drive train, the upper tool part corresponding to a bottom tool part arranged in the bottom section;

at least one motor as a linear and/or a rotary direct drive which is configured to drive the drive device; and a drawing device comprising a holder, wherein, the at least one drive train is configured to be operated so that the at least one drive train is coupled or decoupled to the drawing device by a releasable active connection which is at least one of rotatory and translational in a change of a respective stroke.

28. The press as recited in claim 27, further comprising:

a control and regulation device which is configured to connect the at least one drive train and the at least one motor.

29. The press as recited in claim 27, wherein each of the at least one drive train is associated with one of the at least one motor.

30. The press as recited in claim 27, further comprising:

a shaft-type free space arranged in the bottom section.

31. The press as recited in claim 27, further comprising:

a drawing device, wherein, the at least one drive train is connected to the drawing device.

32. The press as recited in claim 27, wherein, the at least one drive train is coupled to the drawing device during at least a partial path of a downward stroke, and the at least one drive train is decoupled from the drawing device during at least a partial path of an upward stroke.

33. The press as recited in claim 27, wherein a path of the drawing device is at least partially phase-delayed or is less than a path of a complete stroke of the plunger.

34. The press as recited in claim 27, wherein the drawing device comprises a carrier unit which is connected to the at least one drive train in a couplable or decouplable manner in a change via the rotatory or translational active connection by a positive or frictional or force-fit engagement in a causative variable or not variable position relative to the bottom section.

35. The press as recited in claim 27, further comprising:

at least one first force-generating means which is connected above or below to the carrier unit, the at least one first force-generating means being configured to allow for a relative position of the carrier unit in the bottom section.

36. The press as recited in claim 35, further comprising:

at least a second force-generating means which is connected to the carrier unit.

37. The press as recited in claim 36, wherein the carrier unit comprises an intermediate level or a pressure cheek or the intermediate level and the pressure cheek or only the pressure cheek.

38. The press as recited in claim 37, wherein the pressure cheek is arranged above or below the intermediate level and is configured to be drivable either separately or with at least one of the at least one drive train.

39. The press as recited in claim 38, wherein the pressure cheek is arranged in the bottom section above the intermediate level.

40. The press as recited in claim 37, wherein, i. the rotatory or translational active connection comprises at least one first force-generating means cylinder of the first force-generating means, whose first force-generating means piston rod is connected with the pressure cheek and whose first force-generating means piston crown is connected with the drive device or vice versa, and ii. the at least one first force-generating means cylinder is a double-acting cylinder which is configured to an element of the at least one drive train with an acting force or a change of force and a relative position of the pressure cheek by a pressure contact of the first force-generating means piston rod or the first force-generating means piston crown.

41. The press as recited in claim 40, wherein, the drive device comprises a force and path inducing first wheel, and the first force-generating means piston crown is eccentrically hinged to the force and path inducing first wheel for at least one of regulated or controlled sequences of motion sequences, of a pre-acceleration of the pressure cheek, of a pressure application, or of a force generation.

42. The press as recited in claim 41, further comprising:

a second wheel; and a rotary coupling, wherein, the first force-generating piston crown is connected via the second wheel and the force and path inducing first wheel, and the second wheel and the force and path inducing first wheel form a gear of the rotatory coupling, with the drive device for at least one sequence of the regulated or controlled motion sequences, of the pre-acceleration of the pressure cheek, of the pressure application, or of the force generation.

43. The press as recited in claim 42, wherein the at least one acting tie rod comprises a connecting rod which is eccentrically hinged to the force and path inducing first wheel.

44. The press as recited in claim 43, wherein the second wheel comprises an eccentric coupling element which is configured to allow for a movement relative to the second wheel and which acts via a positive, frictional or force-fit engagement.

45. The press as recited in claim 44, wherein the stroke (H) of the at least one plunger, a stroke (h) of the holder, and a stroke (hZyl) in the at least one first force-generating means cylinder are implementable according to a relation $hZyl \geq H-h$, in accordance with an eccentricity (E) $E=H/2$ existing in the second wheel in connection with the eccentric coupling element, wherein, in the combination of the at least one first force-generating means cylinder with the eccentric coupling element of the second wheel, the stroke of the at least one first force-generating means cylinder now serving only for the force generation is small, and a length of a connection of the first force-generating means between the pressure cheek and the eccentric coupling element is implementable so as to be smaller than a length of the connecting rod.

46. The press as recited in claim 45, further comprising:

a translational coupling, wherein, the drive device comprises at least one auxiliary tie rod, and the rotatory or translational active connection of the intermediate level or the pressure cheek or the intermediate level and the pressure cheek occurs via the translational coupling with at least one of the tie rods or the at least the auxiliary tie rod.

47. The press as recited in claim 46, further comprising:

a) an area which is limited by a tie, a shoulder and by a reduced diameter of the at least one acting tie rod or of the auxiliary tie rod;

b) at least one locking unit which is connected with the intermediate level or the pressure cheek or with the intermediate level and the pressure cheek with a locking unit piston and a locking unit cylinder comprising a first chamber and a second chamber as a housing and a locking element; and c) an upper chamber and a bottom chamber of the at least one first force-generating means cylinder of the first force-generating means.

48. The press as recited in claim 47, wherein the first force-generating means is implemented as at least one coupling connecting rod which is configured to connect the carrier unit with the drive device.

49. The press as recited in claim 48, wherein the coupling connecting rod comprises a telescopic extension mechanism which is couplable by a positive, friction or force-fit engagement.

50. The press as recited in claim 49, wherein the carrier unit comprises a parallel and linear guide with the intermediate level or the pressure cheek or the intermediate level and the pressure cheek or only the pressure cheek a shaft-type free free space of the bottom section.

51. The press as recited in claim 50, wherein the rotatory coupling of the at least one drive train of the drive device is arranged in the shaft-type free space or outside thereof.

52. The press as recited in claim 51, wherein the control and regulation device is further configured to transmit a changing or force/path-related control/regulation of the path or force during an operating process.

53. The press as recited in claim 52, wherein a closed force flow for an energy-saving operating process runs through the first force-generating means, by way of the intermediate level or the pressure cheek or the intermediate level and the pressure cheek, the rotatory or translational active connection with each of the at least one drive train, the at least one plunger, the upper tool part, the work piece, and the holder.

* * * * *